US011761205B2

(12) United States Patent
Harnish et al.

(10) Patent No.: US 11,761,205 B2
(45) **Date of Patent: *Sep. 19, 2023**

(54) CEILING SYSTEM

(71) Applicant: ARMSTRONG WORLD INDUSTRIES, INC., Lancaster, PA (US)

(72) Inventors: Scott D. Harnish, Lancaster, PA (US); Nathan H. Canfijn, Lancaster, PA (US)

(73) Assignee: AWI LICENSING LLC, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/669,948

(22) Filed: Feb. 11, 2022

(65) Prior Publication Data

US 2022/0162855 A1 May 26, 2022

Related U.S. Application Data

(62) Division of application No. 16/419,455, filed on May 22, 2019, now Pat. No. 11,280,089.

(60) Provisional application No. 62/676,007, filed on May 24, 2018.

(51) Int. Cl.
*E04B 9/14* (2006.01)

(52) U.S. Cl.
CPC ..... *E04B 9/14* (2013.01)

(58) Field of Classification Search
CPC . E04B 9/064; E04B 9/127; E04B 9/14; E04B 9/183; E04B 9/30; E04B 9/345
See application file for complete search history.

(56) References Cited

U.S. PATENT DOCUMENTS

| | | | | |
|---|---|---|---|---|
| 3,059,735 | A | 10/1962 | Sowinski | |
| 3,798,865 | A * | 3/1974 | Curtis | E04B 9/127 52/715 |
| 4,724,647 | A | 2/1988 | Baird | |
| 5,046,294 | A * | 9/1991 | Platt | E04B 9/127 52/506.06 |
| 5,195,289 | A | 3/1993 | LaLonde | |
| 5,551,792 | A | 9/1996 | Witmyer | |
| 5,572,844 | A | 11/1996 | Stackenwalt | |
| 5,937,605 | A | 8/1999 | Wendt | |
| 6,318,042 | B1 | 11/2001 | Bloom | |
| 7,104,024 | B1 | 9/2006 | diGirolamo | |
| 7,690,168 | B2 | 4/2010 | LaLonde | |
| 7,874,116 | B2 | 1/2011 | LaLonde | |

(Continued)

FOREIGN PATENT DOCUMENTS

EP 0645505 A1 1/1998

*Primary Examiner* — James M Ference
(74) *Attorney, Agent, or Firm* — Patrick Sheldrake

(57) ABSTRACT

A grid mounting system for a suspended ceiling system in one embodiment includes a support structure and a mounting bracket coupled to the support structure. An elongated first grid member is pivotably coupled to the mounting bracket about a pivot axis defined by a pivot member. The first grid member is movable about the pivot axis in a plurality of angular mounting positions. In one embodiment, the grid mounting system further includes a second grid member which may be pivotably or fixedly coupled to the mounting bracket. The support structure may be a wall or perimeter trim bracket attached to the wall in some installations.

20 Claims, 26 Drawing Sheets

(56) References Cited

U.S. PATENT DOCUMENTS

| | | | | |
|---|---|---|---|---|
| 8,215,075 | B2 | 7/2012 | Bergman | |
| 8,443,564 | B2 | 5/2013 | Bankston | |
| 9,181,696 | B1 | 11/2015 | Bergman | |
| 9,187,896 | B1 | 11/2015 | Bergman | |
| 9,187,897 | B1 | 11/2015 | Bergman | |
| 10,036,163 | B1 * | 7/2018 | Paulsen | E04B 1/98 |
| 10,961,704 | B2 * | 3/2021 | Daudet | E04B 2/789 |
| 2003/0205016 | A1 | 11/2003 | Gulbrandsen | |
| 2004/0065037 | A1 | 4/2004 | See | |
| 2005/0160696 | A1 | 7/2005 | Kelly | |
| 2007/0022690 | A1 | 2/2007 | LaLonde | |
| 2008/0060306 | A1 | 3/2008 | Platt | |
| 2009/0235603 | A1 * | 9/2009 | Bergman | E04B 9/20 52/506.08 |
| 2010/0154341 | A1 | 6/2010 | LaLonde | |
| 2011/0146194 | A1 | 6/2011 | Tedesco | |
| 2011/0283634 | A1 | 11/2011 | Underkofler | |
| 2012/0017531 | A1 | 1/2012 | Bankston | |
| 2012/0137615 | A1 | 6/2012 | Wendt | |
| 2014/0000205 | A1 | 1/2014 | Underkofler | |
| 2014/0037366 | A1 * | 2/2014 | Groza | E04B 9/14 403/171 |
| 2016/0102454 | A1 | 4/2016 | Lehane | |
| 2016/0145863 | A1 | 5/2016 | Bergman | |
| 2016/0251855 | A1 | 9/2016 | Heesbeen | |
| 2018/0058068 | A1 | 3/2018 | Bergman | |
| 2018/0066425 | A1 | 3/2018 | Ralph | |
| 2019/0292781 | A1 | 9/2019 | Neal | |
| 2019/0360203 | A1 | 11/2019 | Harnish | |
| 2022/0162855 | A1 * | 5/2022 | Harnish | E04B 9/064 |

* cited by examiner

CEILING SYSTEM

CROSS-REFERENCE TO RELATED APPLICATIONS

This application is a divisional of U.S. patent application Ser. No. 16/419,455, filed on May 22, 2019, now allowed, which in turn claims the benefit of U.S. Patent Application No. 62/676,007 filed on May 24, 2018. The disclosure of the above applications are incorporated herein by reference in their entireties.

FIELD

The present invention relates to suspended ceiling systems, and more particularly to a system for assembling and mounting components of a ceiling support grid.

BACKGROUND

Numerous types of suspended ceiling systems and methods for mounting ceiling panels have been used. One conventional type of system comprises a ceiling panel support grid including an array of perpendicularly intersecting grid members hung or supported from an overhead support structure and/or perimeter walls. Ceiling panels having a traditional square or rectangular shape are mounted in rectilinear openings formed by the support grid. The grid members generally include an array of longitudinally-extending main beams or runners, and laterally-extending cross members or tees spanning between the main beams.

In some ceiling designs including ceiling panels having a non-traditional shape (e.g. triangular or other polygonal shapes), a problem occurs with terminating a plurality of obliquely-oriented grid members such as mains and tees at a common angular mounting vertex or junction at the intersection of these members which may be located at the ceiling perimeter and/or at interior grid members. Conventional grid member termination technologies cannot be readily located at the same physical location in the case of an angular junction. This prevents grid members from being successfully terminated with commonly-used mechanical techniques (e.g. tabs or screws) at the wall or grid members without substantial difficulty maintaining the correct grid angular relationship between the grid members at their terminal intersection due to the complex geometries encountered.

An improved ceiling system is desired which can facilitate terminating a plurality of angled grid members at the common mounting junction to accommodate ceiling panels of a non-rectilinear shape.

SUMMARY

The present invention provides a grid mounting system for a suspended ceiling which permits terminating a plurality of angularly-intersecting grid members at a common mounting vertex or junction. The mounting system includes a mounting bracket and clip assembly which couples the terminal ends of grid members together at the mounting junction while maintaining the desired angular orientation and relationship between the grid members. This allows creation of ceiling panel openings in the support grid configured to receive ceiling panels having a non-rectangular polygonal shape, such as for example without limitation triangular, rhomboidal, parallelogram, and others polygonal shapes including various combinations thereof. The design flexibility afforded by the mounting system advantageously allows the ceiling designer to create various geometrics which are aesthetically and architecturally interesting.

In one embodiment, the grid mounting system includes a mounting bracket fixedly attachable to a support structure. The support structure may be a perimeter wall, or a wall-mounted or overhead-suspended grid member or trim piece. One or more angularly-adjustable grid members may be fixedly and/or pivotably coupled to the bracket. The pivotably mounted grid members may be angularly adjusted in a continuum of positions relative to the first grid member between an angle of 0 and 180 degrees in one embodiment. These positions include perpendicular angles and oblique angles relative to the support structure and other grid members.

In one aspect, a grid mounting system comprises: a support structure; a mounting bracket coupled to the support structure; an elongated first grid member coupled to the mounting bracket and angularly disposed relative to the support structure; and an elongated second grid member pivotably coupled to the first grid member and movable about a pivot axis in a plurality of angular mounting positions relative to the first grid member.

In another aspect, a grid mounting system comprises: a support structure; a mounting bracket fixedly coupled to the support structure and comprising a pivot member; an elongated first grid member pivotably coupled to the mounting bracket about a pivot axis, the first grid member movable about the pivot axis in a plurality of angular mounting positions.

In another aspect, a grid mounting system comprises: a support structure; a mounting bracket slideably coupled to the support structure and movable in a plurality of horizontal mounting positions; and an elongated first grid member pivotably coupled to the mounting bracket and movable about a pivot axis in a plurality of angular mounting positions.

BRIEF DESCRIPTION OF THE DRAWINGS

The features of the exemplary embodiments of the present invention will be described with reference to the following drawings, where like elements are labeled similarly, and in which.

Figure 1:
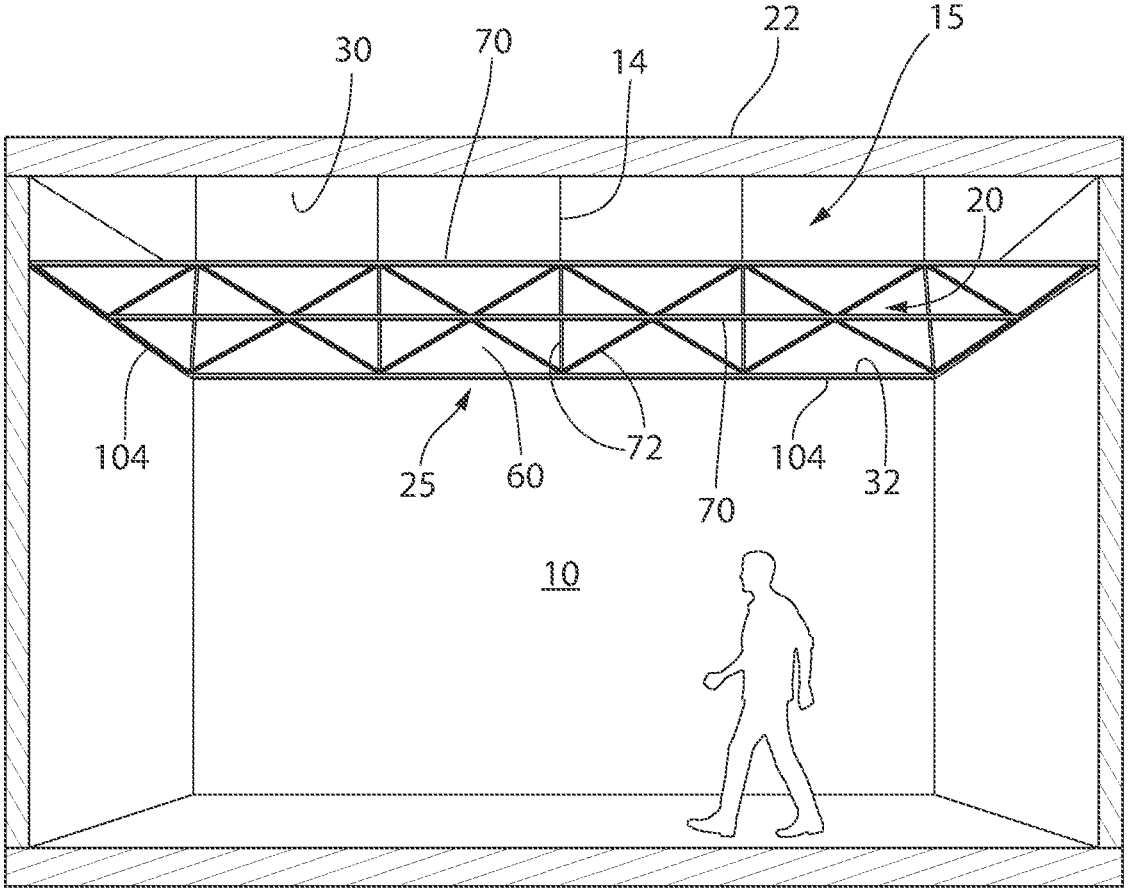
FIG. 1 is a perspective view a ceiling system including a grid mounting system according to the present disclosure.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION

The features and benefits of the invention are illustrated and described herein by reference to exemplary ("example") embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Figure 2:
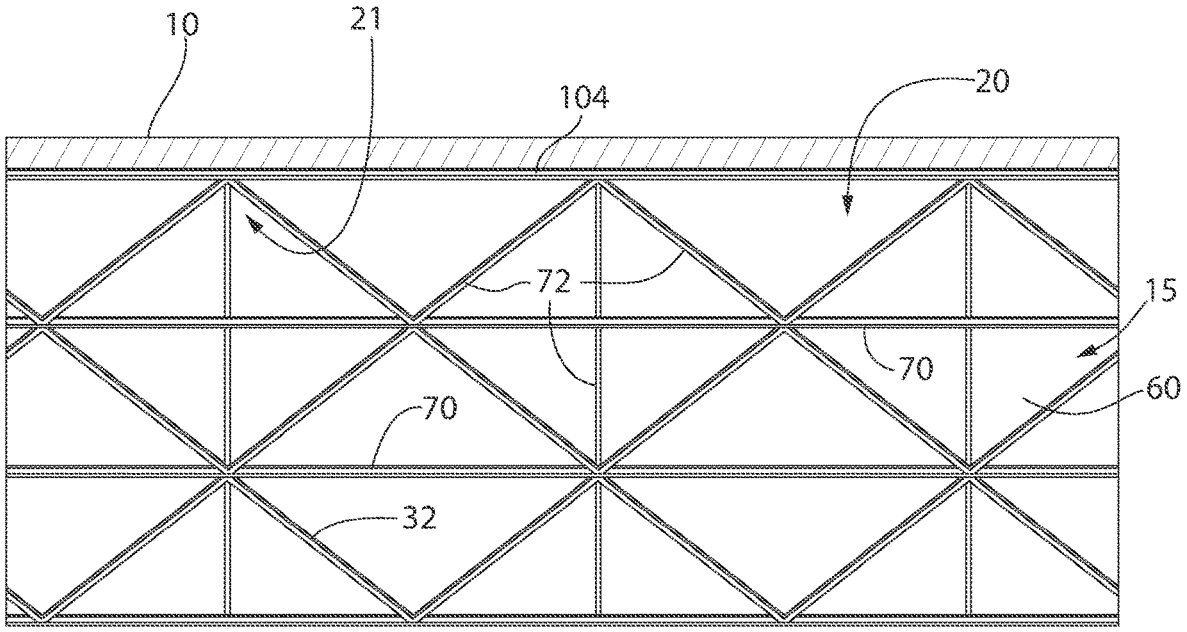
FIG. 2 is a top view of a portion of the ceiling system.
Figure 3:
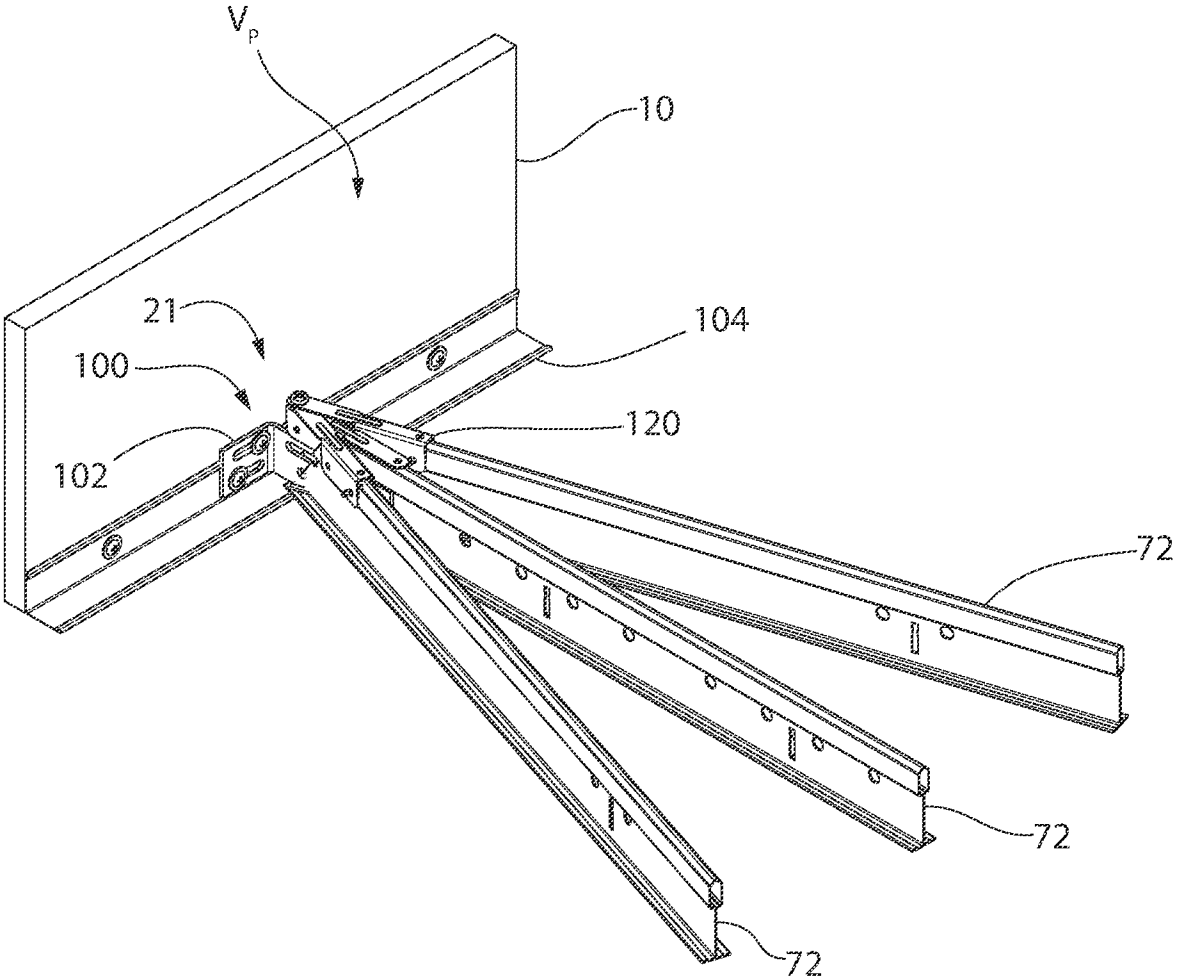
FIG. 3 is a perspective view of the grid mounting system including a first embodiment of a grid junction mounting bracket and related components.
Figure 4:
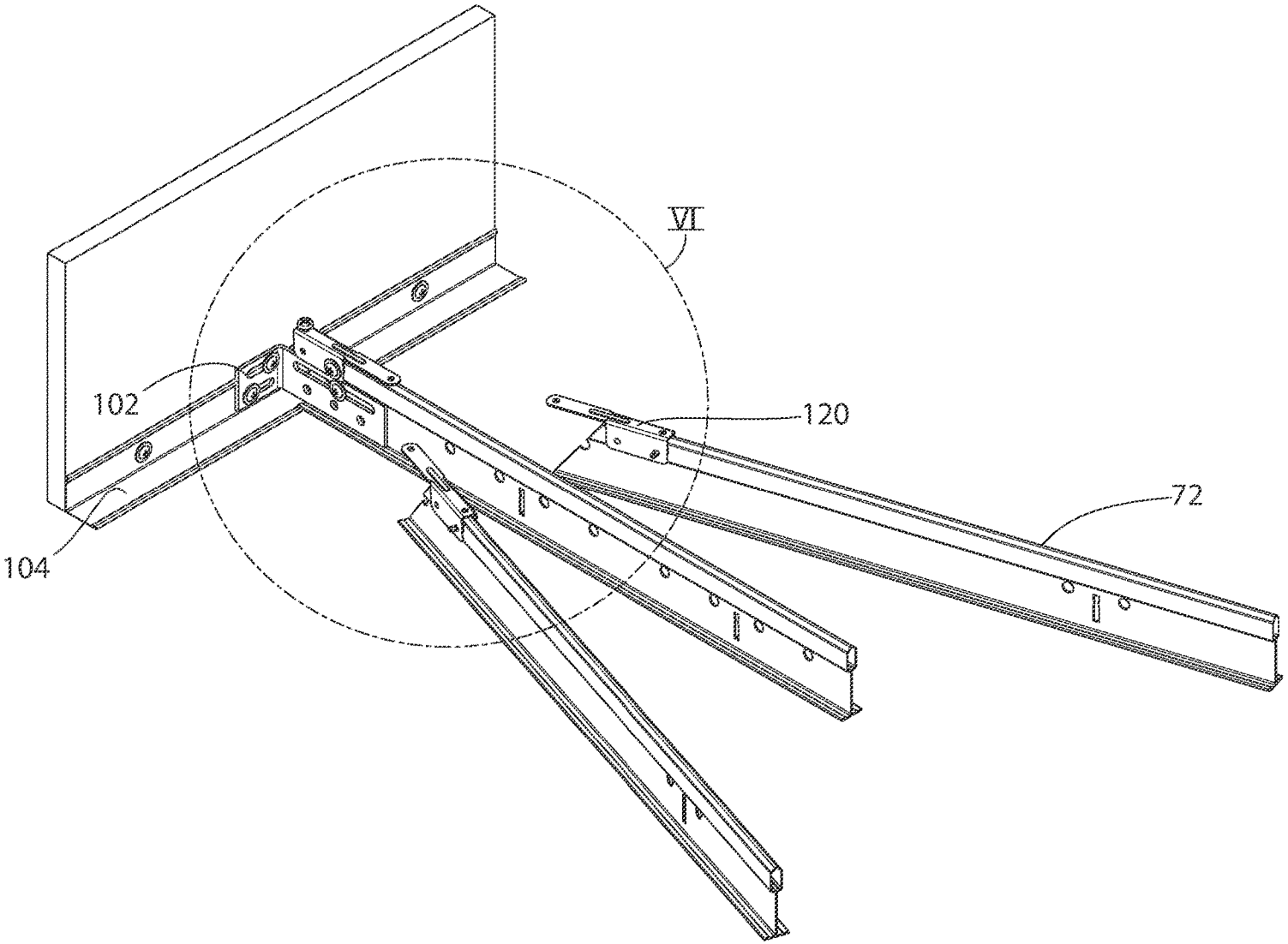
FIG. 4 is a partial exploded perspective view thereof.
Figure 5:
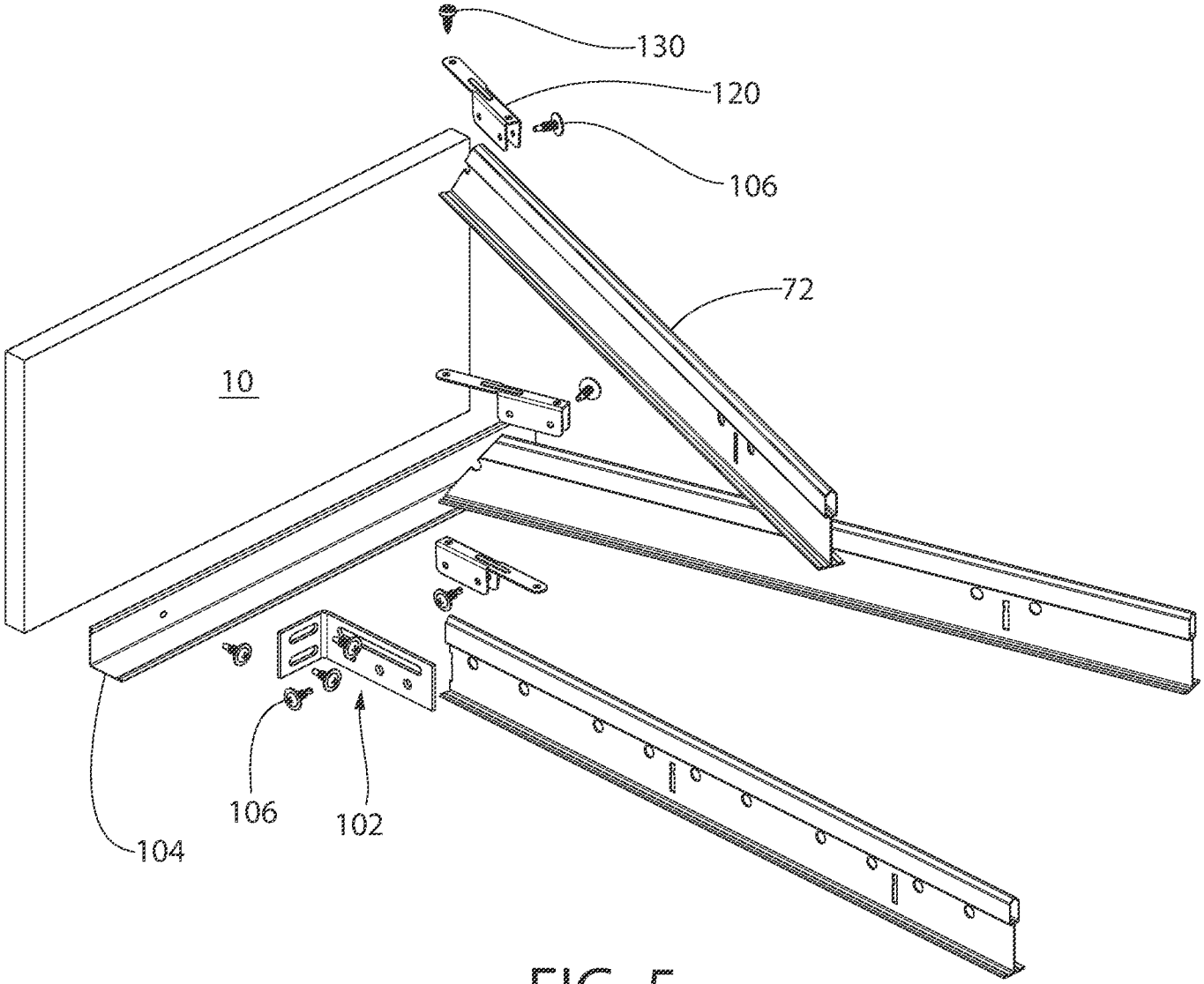
FIG. 5 is a fully exploded perspective view.
Figure 6:
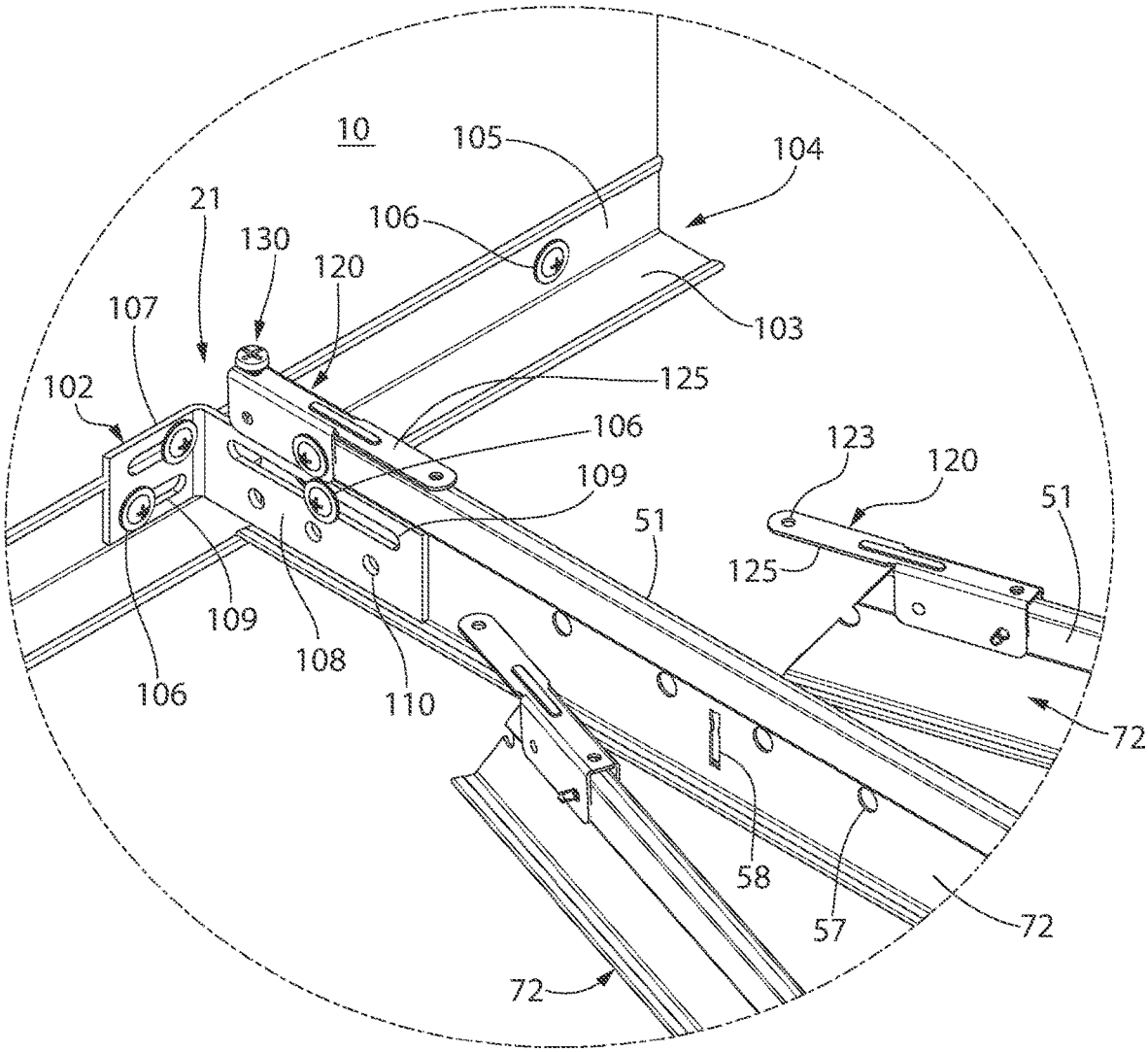
FIG. 6 is an enlarged detail taken from FIG. 4.
Figure 7:
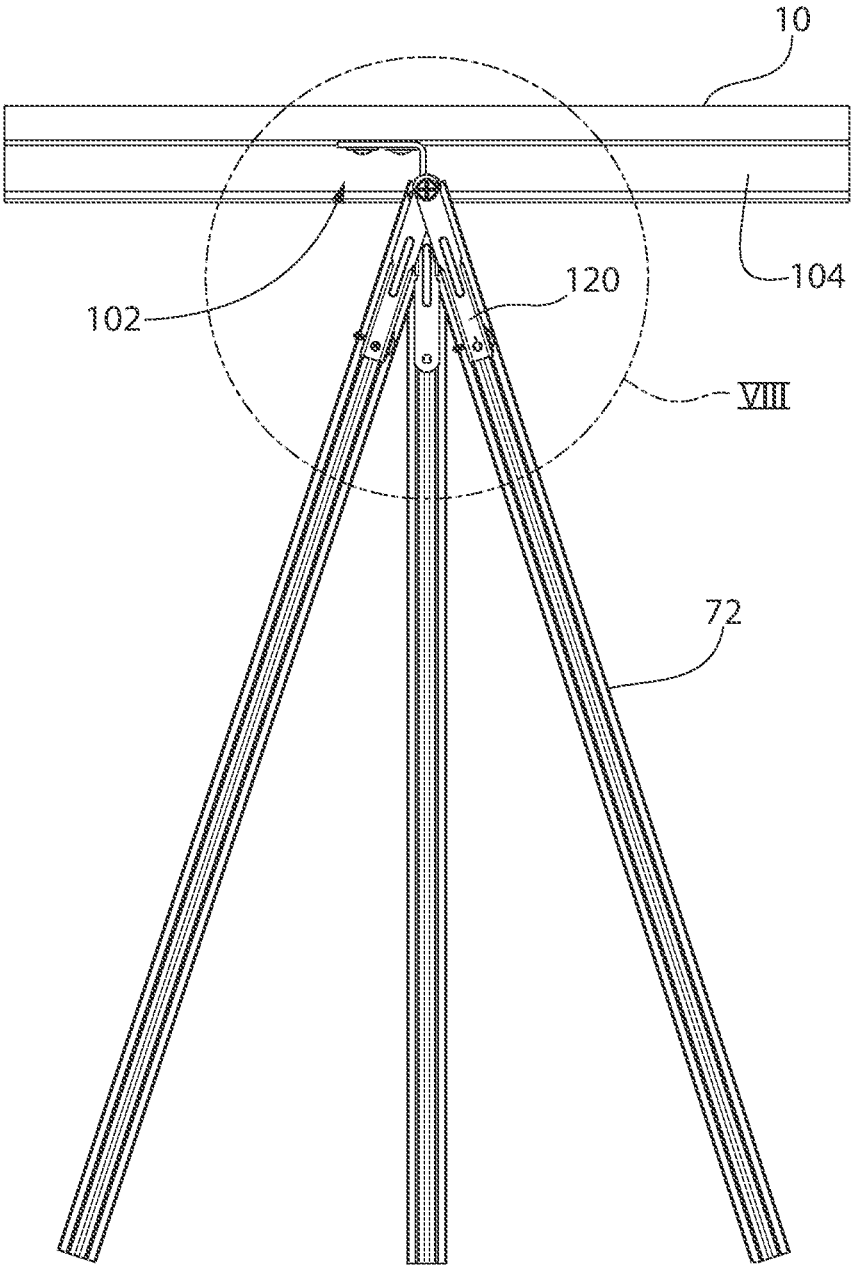
FIG. 7 is a top plan view of the grid mounting system.
Figure 8:
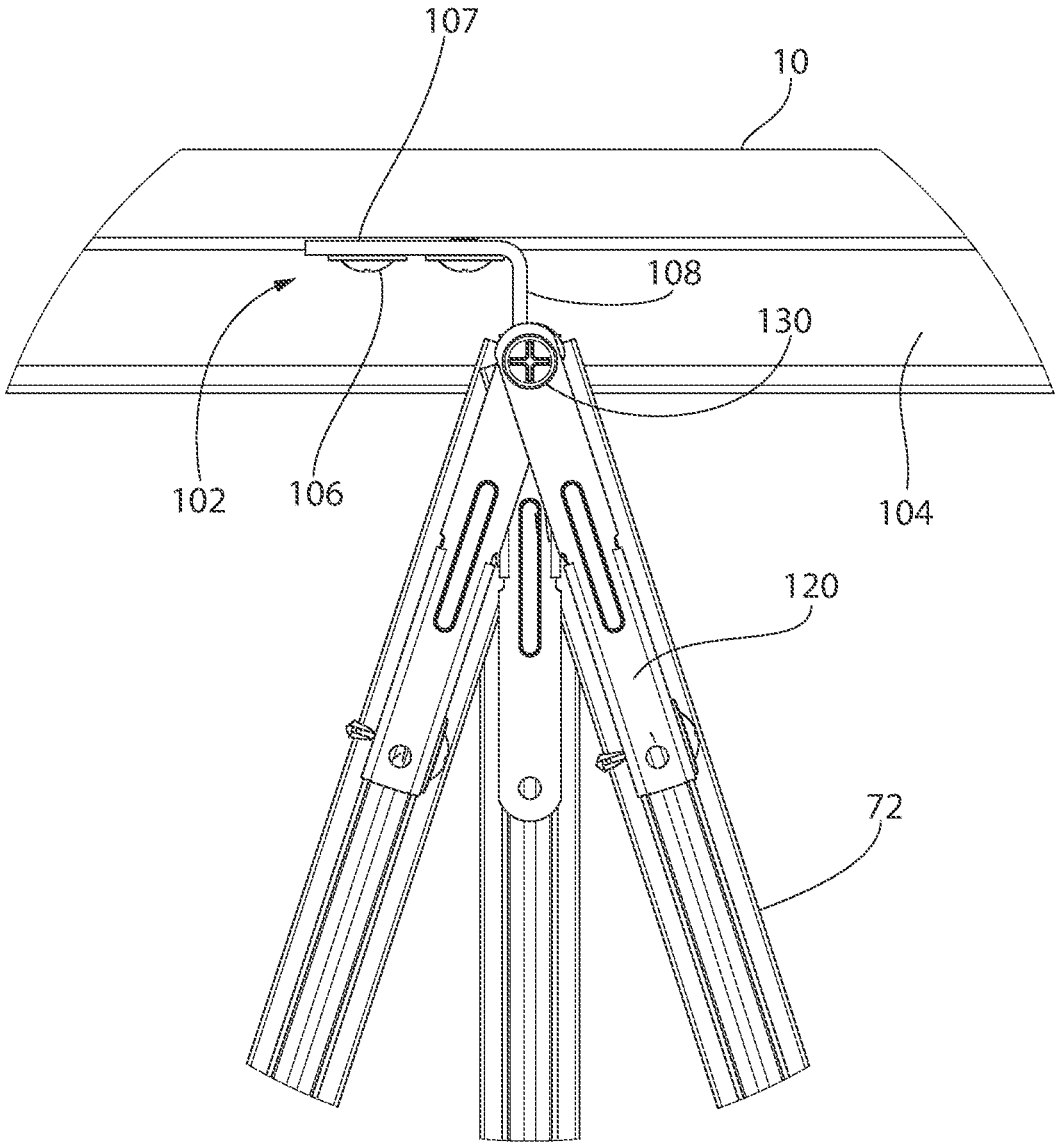
FIG. 8 is an enlarged detail taken from FIG. 7.
Figure 9:
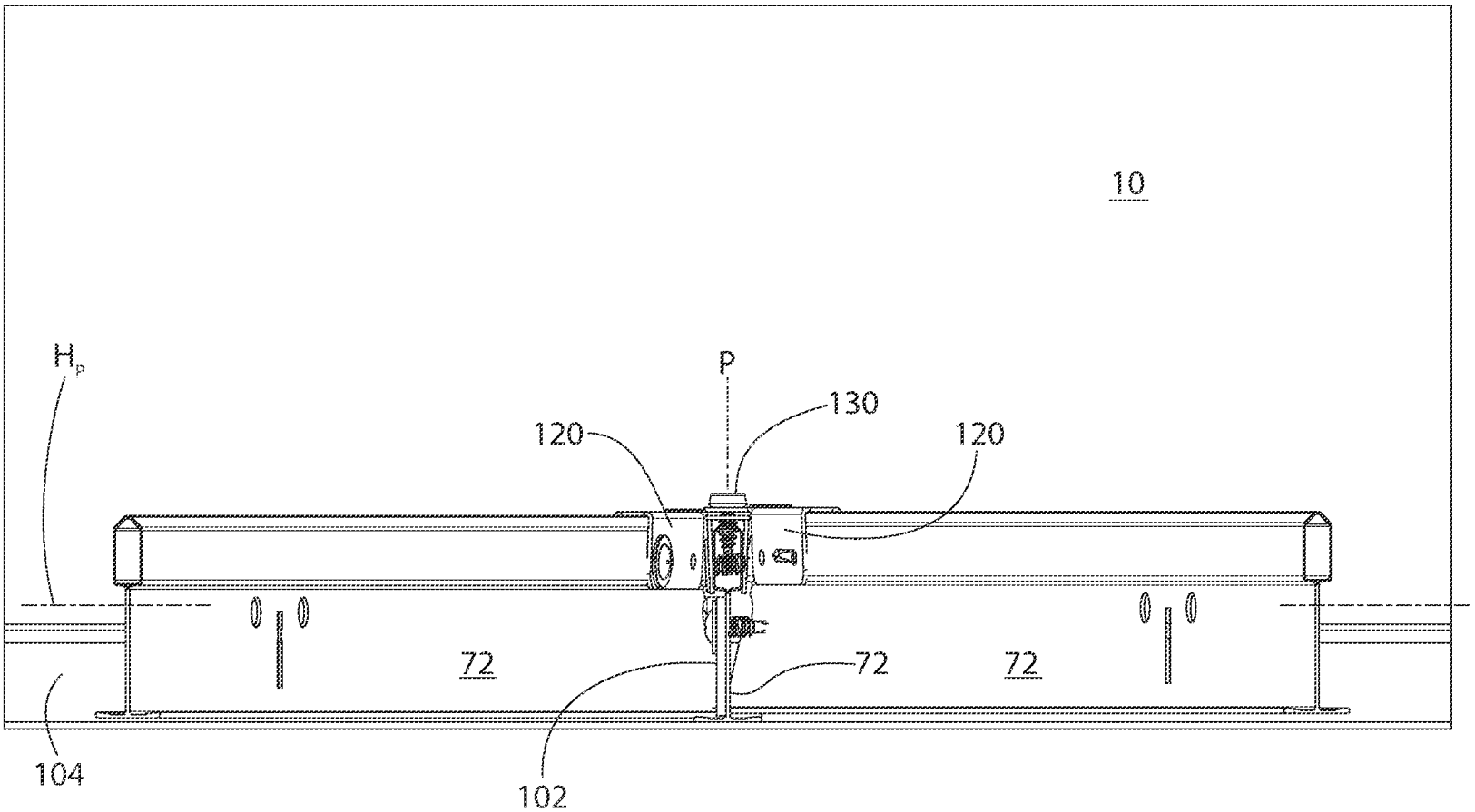
FIG. 9 is a front view of the grid mounting system.
Figure 10:
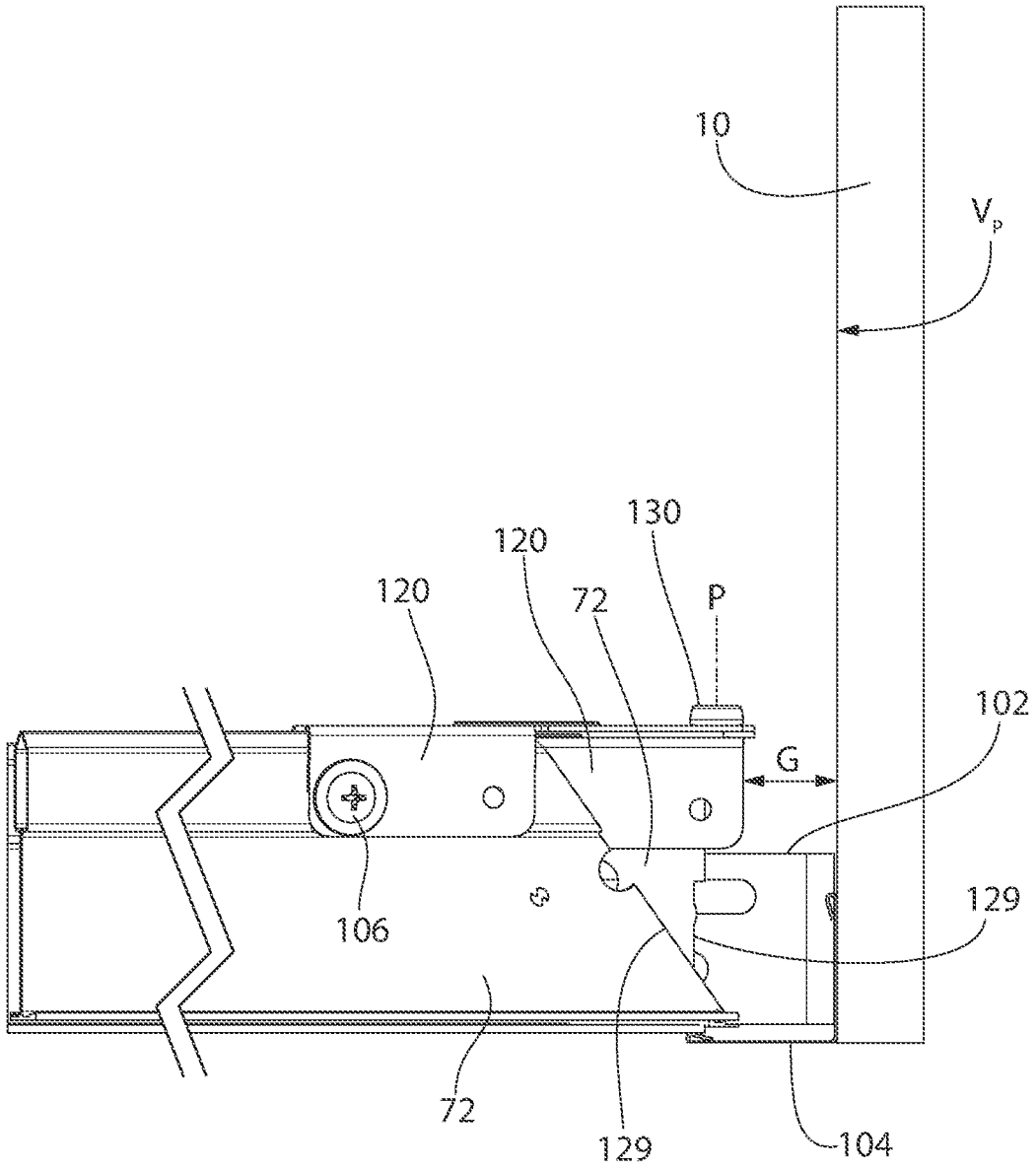
FIG. 10 is a side view thereof.
Figure 11:
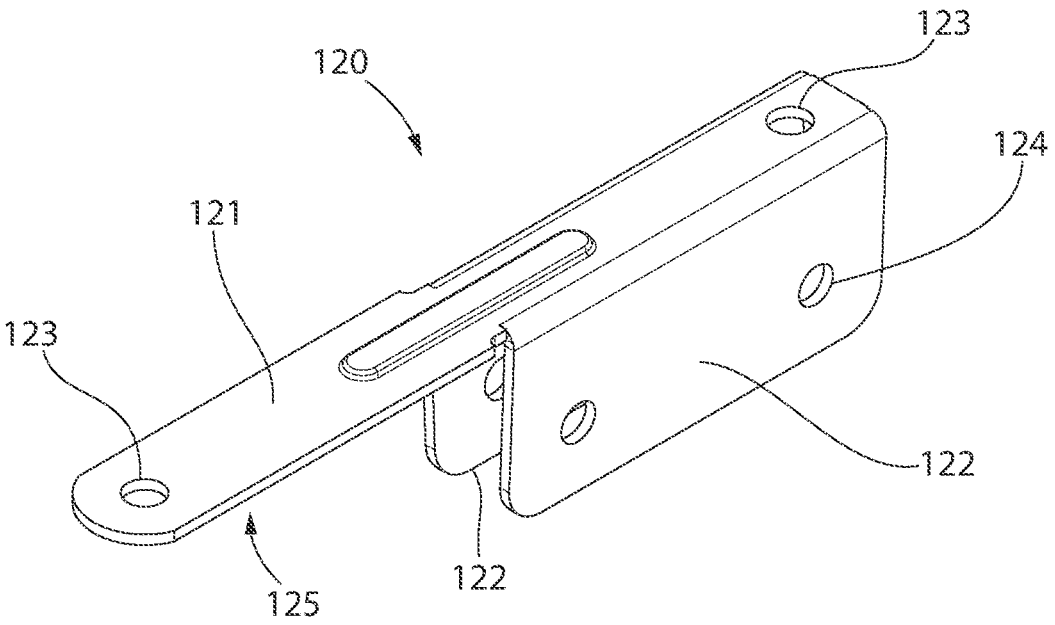
FIG. 11 is a top perspective view of one of the coupling clips of the grid mounting system.
Figure 12:
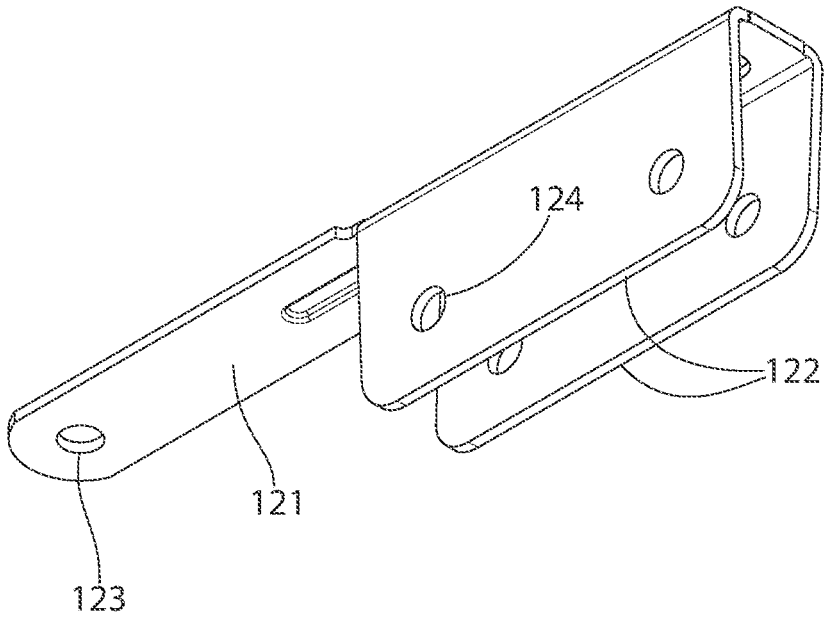
FIG. 12 is a bottom perspective view thereof.
Figure 13:
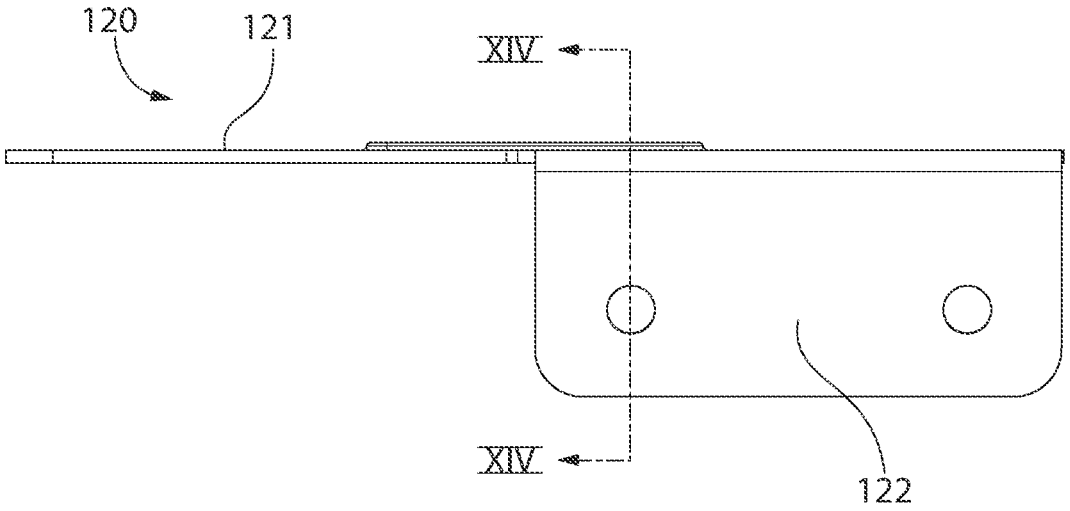
FIG. 13 is a side view thereof.
Figure 14:
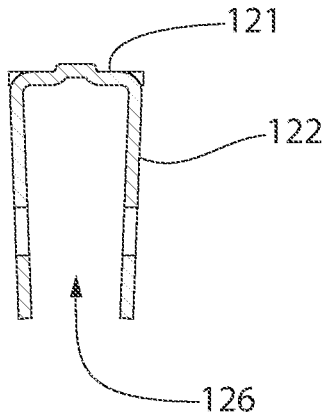
FIG. 14 is a transverse cross sectional view thereof.
Figure 15:
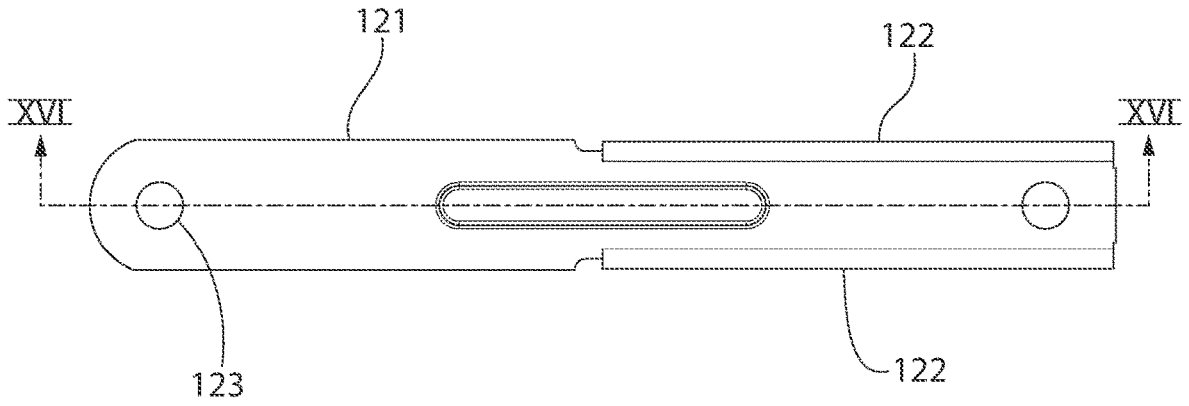
FIG. 15 is a bottom plan view thereof.
Figure 16:
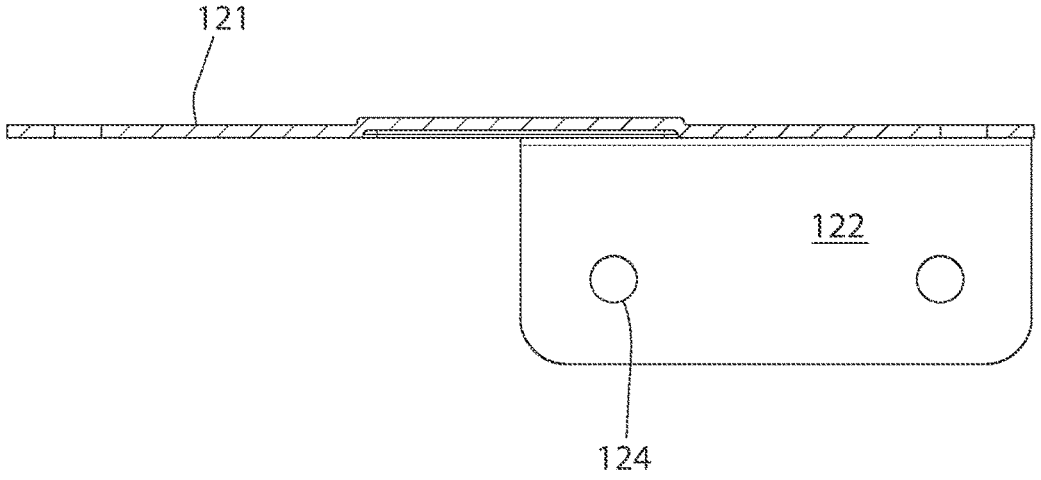
FIG. 16 is a longitudinal cross-sectional view thereof.
Figure 17:
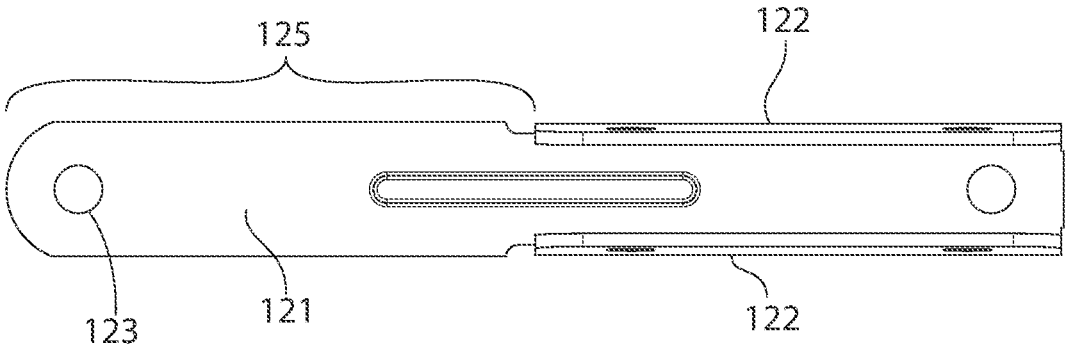
FIG. 17 is a top view thereof.

FIGS. 1 and 2 depict partial portions of a non-limiting embodiment of a ceiling system 15 including a grid mounting system 20 according to the present disclosure. The ceiling system 15 includes an overhead support grid 25 mountable in a suspended manner from a building overhead support structure 22 and/or walls 10 of the building. Support grid 25 includes a plurality intersecting and elongated grid members including main beam grid members 70 and cross grid members 72. Main beam grid members 70 are arranged parallel to each other and hung from and supported by building overhead support structure 22 via a plurality of hangers 14, which in some embodiments may be rods or wires as commonly used in the industry. The cross grid members 72 may angularly intersect the main beam grid members 70 at a variety of angles including oblique and/or perpendicular angles. Terminal ends of the grid members 70 and 72 are coupled to and supported by either other grid members and/or perimeter trim brackets 104 fixedly attached to the walls 10 as shown such as via threaded fasteners or other means.

Grid members 70, 72 are longitudinal and axially elongated in shape having a length greater than their respective width (e.g. at least twice), and in various embodiments lengths substantially greater than their widths (e.g. 3 times or more). The grid members 70, 72 are arranged and spaced at appropriate intervals to form a desired grid configuration. In one embodiment, grid members 70, 72 may be horizontally oriented when installed. It will be appreciated, however, that other suitable mounted orientations of the grid members 70, 72 are possible in other embodiments such as angled or slanted (i.e. between 0 and 90 degrees to horizontal). Accordingly, although grid members 70, 72 may be described and shown in one exemplary orientation herein as horizontal, the invention is not limited to this orientation and other orientations may be used.

Grid members 70, 72 are arranged to intersect and form an array of grid openings 32 which essentially become closed by ceiling panels 60 mounted below and/or within the openings to the support grid. In some embodiments, at least some of the cross grid members 72 may be arranged in a non-orthogonal intersecting pattern wherein they intersect at other than right angles to form grid openings 208 of non-rectilinear polygonal shape for mounting ceiling panels 60 having a complementary configuration to the openings. Examples of these polygonal shaped ceiling panels 60 and grid opening 32 include for example without limitation singular or combinations of triangular, rhomboidal, parallelogram, and other polygonal configurations.

Main beam and cross grid members grid support members 70, 72 may be T-shaped (e.g. T-rails) in transverse cross section. The grid support members have an inverted T-shaped configuration when in an installed position mounted to a building overhead or wall support structure.

Figure 32:
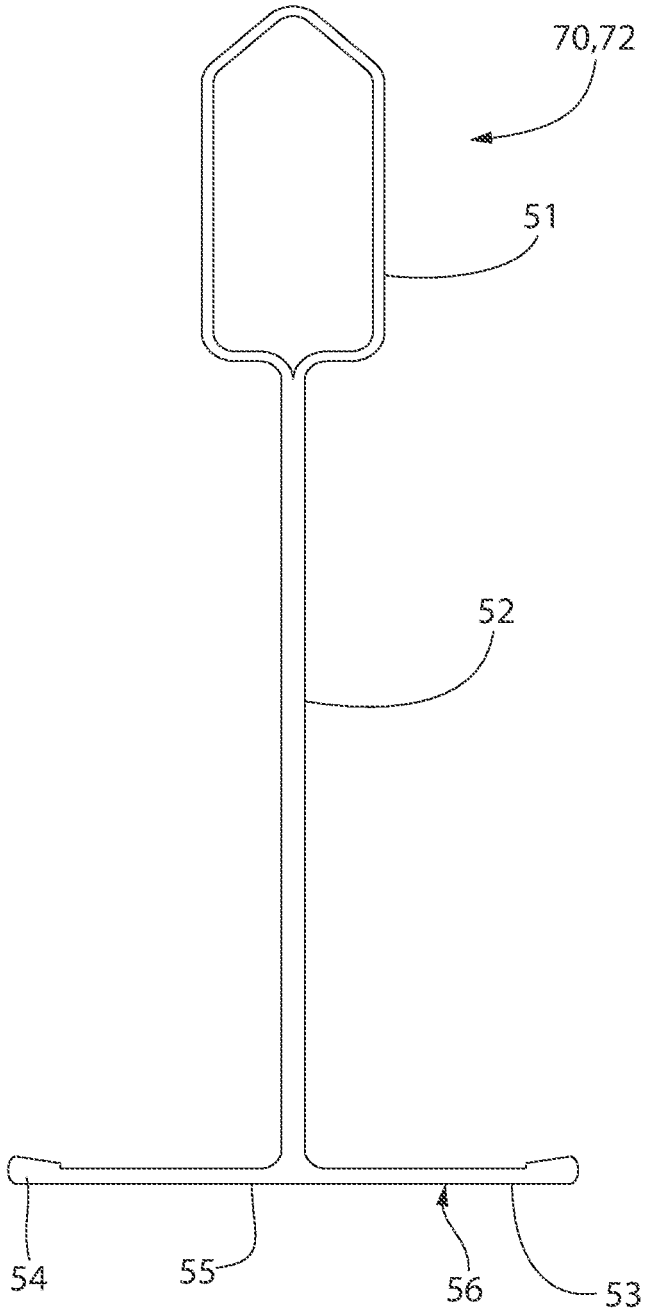
FIG. 32 is an end view of a grid member mounted via the first, second or third embodiments of the grid junction mounting brackets.

Because the grid members 70, 72 primarily support the weight of the ceiling panels 60 via attachment to the building overhead ceiling support structure 22 and walls 10, they have a structurally robust construction to provide lateral stiffness to the support grid and maintain the dimensions of the grid openings in which the ceiling panels 60 are installed. Referring to FIG. 32, each grid member 70, 72 includes a longitudinally-extending horizontal bottom flange 53, a bulbous top stiffening channel 51, and a vertical web 52 extending upwards from the flange to the stiffening channel. The grid members 70, 72 each define a respective longitudinal axis LA and axial directions. Web 52 may be centered between opposing longitudinally extending edges 54 of flange 53 in one embodiment. Bottom flange 53 has opposing portions which extend laterally outwards from web 52 and terminating in the opposed longitudinally extending edges 54. In one embodiment, edges 54 may have a slightly enlarged bulbous configuration in transverse cross-section as shown. Bottom flange 53 further defines a bottom surface 56 facing downwards away from the flange and towards a room or space below the support grid 25.

In some embodiments, the grid members 70, 72 may include a plurality of mounting holes 57 to facilitate hanging the members from the ceiling overhead support structure 22 of the building via hangers 14. The mounting holes 57 may be formed in the web 52 of the grid members 70, 72. A plurality of elongated slots 58, which may be vertical, may also be formed in the webs 52 for insertion of tabs (not shown) from the ends of adjoining grid members 70, 72 for connecting these members together at a joint in perpendicular or obliquely angled relationship. Horizontal slots 58 may also be provided in some embodiments.

Grid members 70, 72 may be made of any suitable metallic or non-metallic materials structured to support the dead weight or load of ceiling panels without undue deflection. In some preferred but non-limiting embodiments, the grid members may be made of metal including aluminum, titanium, steel, or other. In one embodiment, the grid members 70, 72 may be a standard heavy duty 15/16 inch aluminum T-rail.

Various type of ceiling panels 60 can be used with the present grid system, such as for example without limitation acoustical panels or tiles, wood, metal, and plastics. In the case of acoustical panels, the panels may comprise fiberglass, mineral wool (such as rock wool, slag wool, or a combination thereof), synthetic polymers (such as melamine foam, polyurethane foam, or a combination thereof), mineral cotton, silicate cotton, gypsum, or combinations thereof. In some embodiments, the panel provides a sound attenuation function and preferred materials for providing the sound attenuation function include mineral wool. Such a panel can provide a CAC (Ceiling Attenuation Class) rating of at least 35, preferably at least 40. CAC is further described below. In some non-limiting embodiments, the panel may be selected from the School Zone™ and Calla™ panel lines produced by Armstrong—for example, School Zone 1810.

Acoustic ceiling panels exhibit certain acoustical performance properties. Specifically, the American Society for Testing and Materials (ASTM) has developed test method E1414 to standardize the measurement of airborne sound attenuation between room environments 3 sharing a common plenary space 2. The rating derived from this measurement standard is known as the Ceiling Attenuation Class (CAC). Ceiling materials and systems having higher CAC values have a greater ability to reduce sound transmission through a plenary space—i.e. sound attenuation function.

Another important characteristic for acoustic ceiling panel materials is the ability to reduce the amount of reflected sound in a room. One measurement of this ability is the Noise Reduction Coefficient (NRC) rating as described in ASTM test method C423. This rating is the average of sound absorption coefficients at four ¼ octave bands (250, 500, 1000, and 2000 Hz), where, for example, a system having an NRC of 0.90 has about 90% of the absorbing ability of an ideal absorber. A higher NRC value indicates that the material provides better sound absorption and reduced sound reflection—sound absorption function.

FIGS. 3-10 depict a first embodiment of a grid mounting system 20 with grid junction bracket assembly 100 according to the present disclosure. The bracket assembly 100 permits terminating a plurality of angularly-intersecting grid members at a common mounting vertex or junction 21 with relative ease. Advantageously, bracket assembly 100 is configured to avoid the complex geometries and conventional mounting hardware when mounting terminal ends of grid members together at such intersections or junctions commonly encountered when hanging non-rectilinear ceiling panel designs.

Grid junction bracket assembly 100 includes a mounting bracket 102 and one or more couplers such as U-shaped coupling clips 120 in one embodiment configured for attachment to the terminal ends of cross grid members 72. In this example, mounting bracket 102 is fixedly attached to building structural wall 10 through an intermediate support structure which may be perimeter trim bracket 104. Wall 10 which defines a vertical reference plane Vp. In other installations, mounting bracket 102 may instead be attached to a support structure which may be a main beam grid member 70.

Perimeter trim bracket 104 is longitudinally-elongated and fixedly attached to wall 10 in a horizontal orientation by a suitable mechanical means such as fasteners 106, which may be threaded fasteners in one embodiment such as screws. Perimeter trim bracket 104 has an angled configuration including a vertical flange 105 which engages wall 10 and horizontal cantilevered flange 103 arranged perpendicularly to flange 105. Flange 103 conveniently provides a horizontal ledge on which peripheral edges of the ceiling panel are seated to perimetrically support the panel. Mounting bracket 102 may be fixedly attached to trim bracket 104 via threaded fasteners 106 spaced longitudinally apart on trim bracket 104.

Mounting bracket 102 has an angled configuration including a vertical first flange 107 arranged parallel to wall 10 and vertical reference plane Vp, and a vertical second cantilevered flange 108 extending perpendicularly to the first flange and the vertical reference plane and wall. A pair of parallel horizontally elongated slots 109 may be formed in flange 107 to allow horizontal adjustment of the position of mounting bracket 102 relative to wall 10 and perimeter trim bracket 104 for properly locating the bracket to attach cross grid members 72, as further described herein.

A first cross grid member 72 is fixedly attached to the cantilevered flange 108 of mounting bracket 102 by a fastener 106 (e.g. screw as shown). This grid member 72 is perpendicularly oriented relative to perimeter trim bracket 104 and wall 10 (including vertical reference plane Vp). Flange 108 may include a plurality of holes 110 and a horizontally elongated slot 109 to allow in-field adjustment of grid member 72 in position relative to the wall 10 and perimeter trim bracket 104. To adjust the grid member 72, fastener 106 may be loosely inserted through slot 109 and one of the holes 57 formed in the web 52 of grid member 72. The grid member 72 may then be slid towards or away from wall 10 to the desired position, after which the fastener may be fully tightened to lock the grid member in place. An additional fastener 106 may optionally be screwed through one of the round holes 110 in flange 108 and the web 52 of the grid member 72 to further fix the position of the grid member relative to the mounting bracket 102. Once fixed in position relative to the wall 10 and mounting bracket 102, the first cross grid member 72 is stationary and not angularly adjustable.

Grid mounting system 20 can accommodate a movable second and optionally third cross grid member 72 as shown in FIGS. 3-10. The third cross grid member 72 may be omitted in some embodiments depending on the desired ceiling grid configuration and non-rectilinear polygonal shape(s) of ceiling panels 60 to be used. The second and third grid members 72 are pivotably coupled to the stationary first cross grid member 72 by the coupling clips 120. Second and third grid members 72 are angularly movable and adjustable relative to stationary first grid member 72 (and wall 10/vertical reference plane VP) in a horizontal plane which includes the stationary first grid member.

FIGS. 11-18 show coupling clips 120 in greater detail. Each coupling clip 120 has a body including an elongated top flange 121 and a pair of laterally spaced apart side flanges 122 extending downwardly from the top flange to engage respective opposing sides of the grid members 72 on which they are mounted. The side flanges 122 define a downward open cavity 126 configured to receive the bulbous top channel 51 of grid member 72 when mounted thereto.

Figure 18:
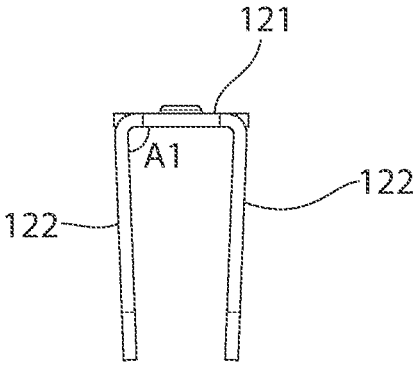
FIG. 18 is an end view thereof.
Figure 19:
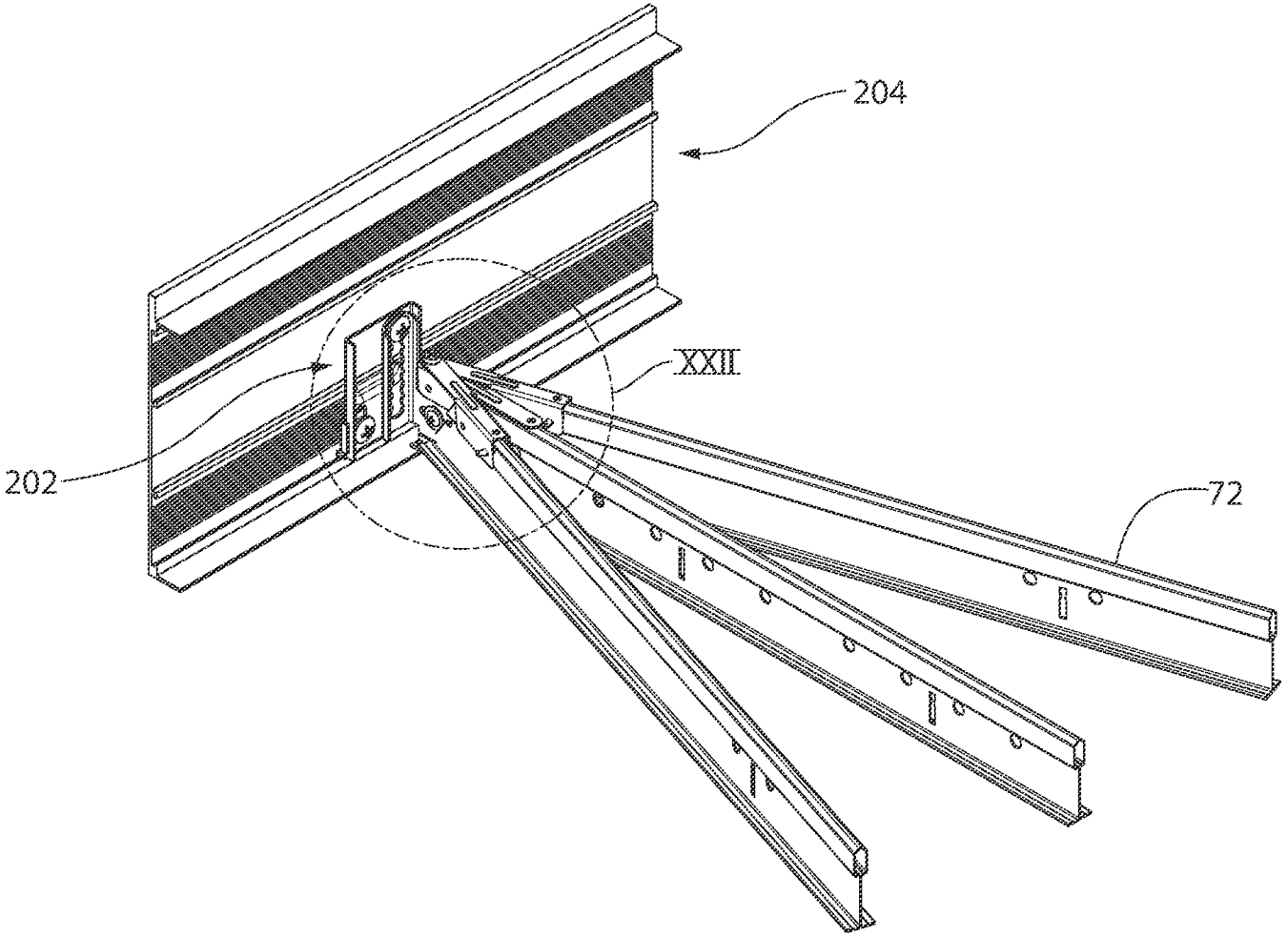
FIG. 19 is a perspective view of a second embodiment of a grid mounting system including a second embodiment of a grid junction mounting bracket and related components.
Figure 20:
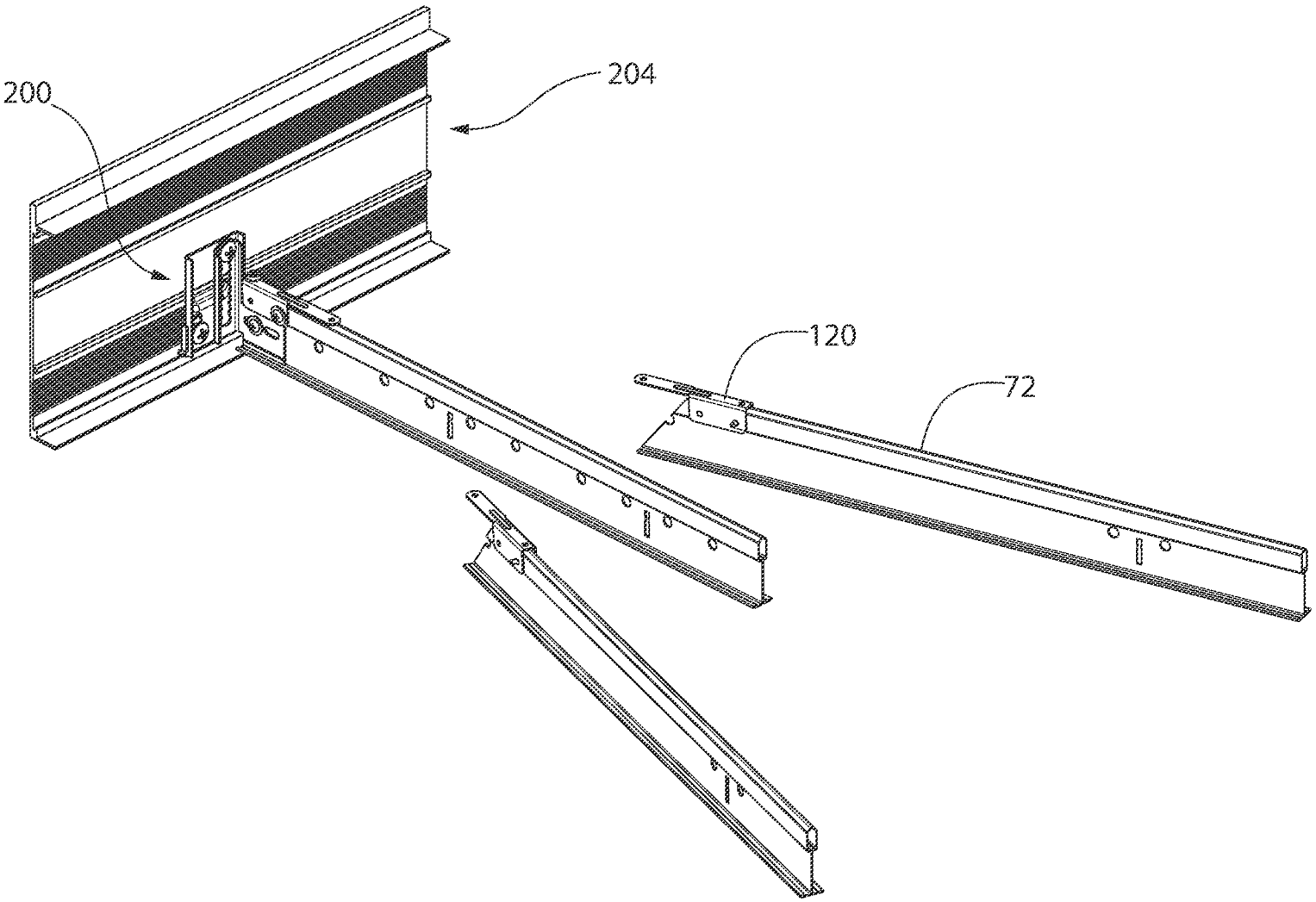
FIG. 20 is a partial exploded perspective view thereof.
Figure 21:
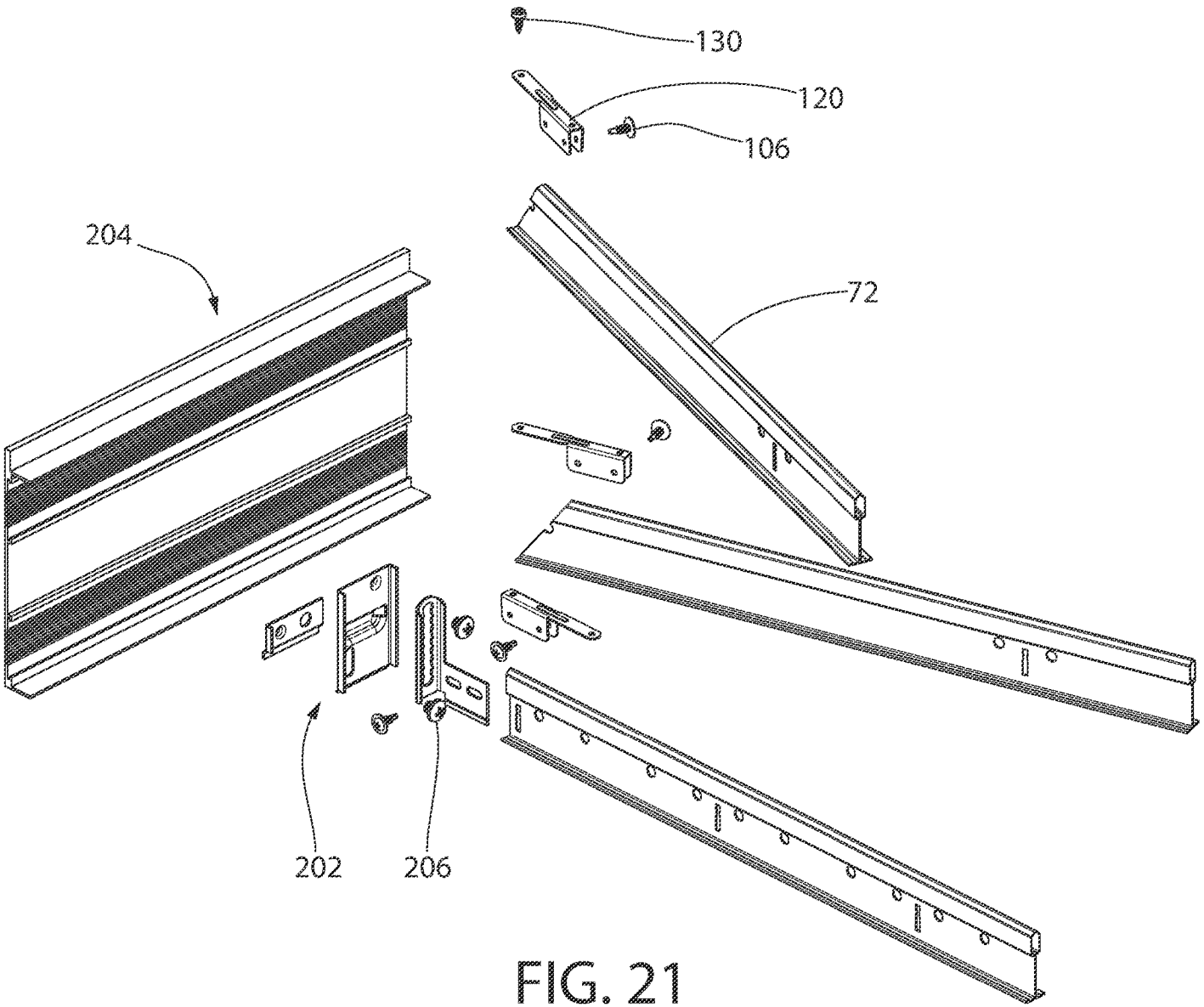
FIG. 21 is a fully exploded perspective view.
Figure 22:
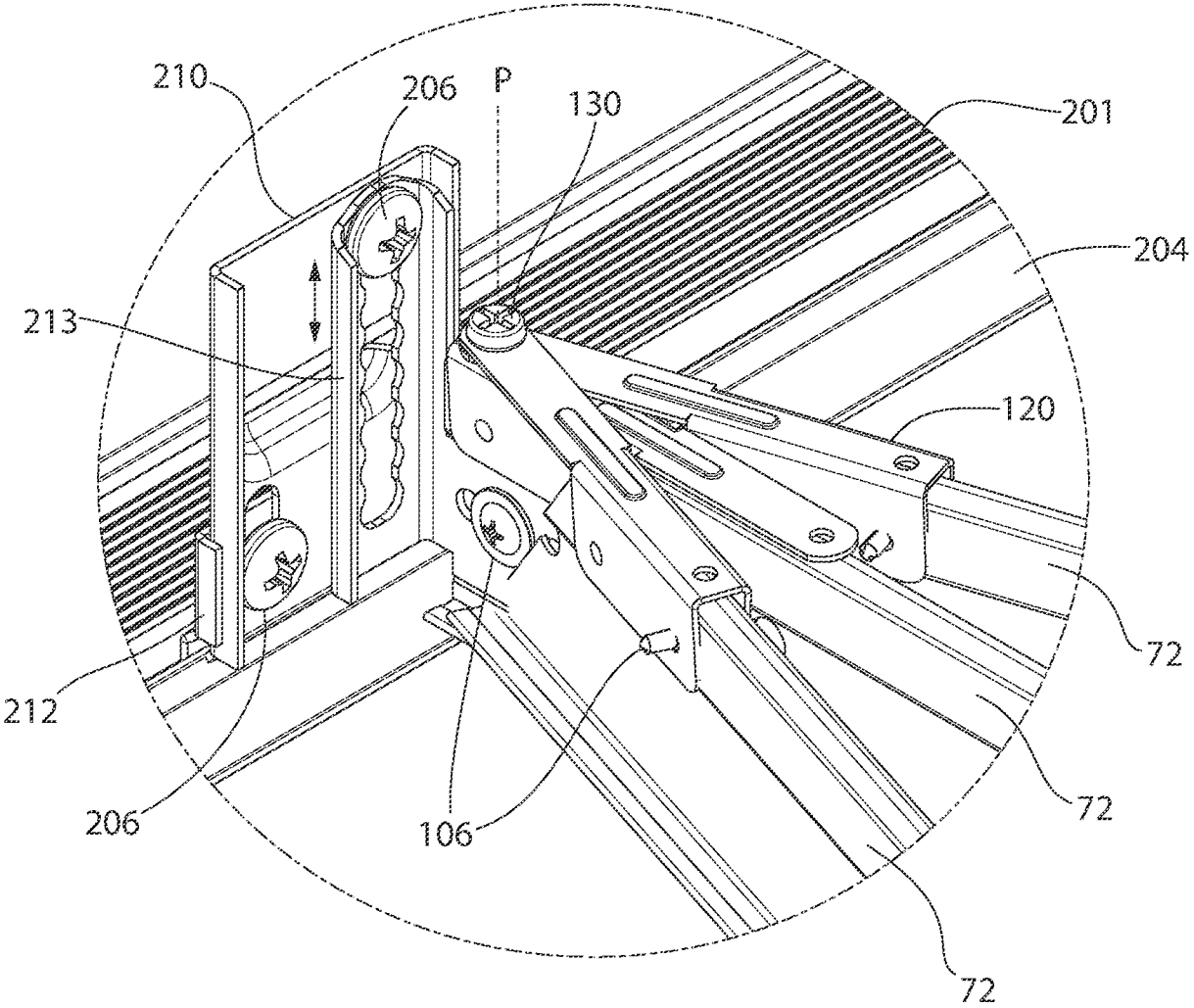
FIG. 22 is an enlarged detail taken from FIG. 19.

Side flanges 122 of coupling clip 120 may be orientated generally perpendicularly to top flange 121, but preferably in one embodiment are angled inwardly slightly toward each other in a converging relationship, thereby forming acute angles Al to the top flange (see, e.g. FIG. 18). This allows the side flanges to frictionally grip the bulbous top channel 51 of the grid members 72 when mounted thereto. Coupling clips 120 are preferably formed of a metallic or non-metallic material with a degree of elastic memory. In some embodiments, clips 120 may be formed of aluminum or steel of suitably thin thickness to be deformable. When pushed downward over the top channel 51 of grid member 72, the side flanges 122 deflect and expand outwards away from each other while sliding down along the channel. When the coupling clip 120 is fully seated on the grid member 72, the elastic memory of clip material causes the side flanges 122 to try to return inwards to their original undeformed or undeflected condition, thereby frictionally clamping the clip to the top channel 51 of the grid member. In some embodiments, the side flanges 122 each include a pair of mounting holes 124 to further secure the coupling clip 120 to the grid member 72 via one or more threaded fasteners 106 such as screws. The holes 124 in one side flange 122 are laterally and concentrically aligned with a mating hole 124 in the other side flange. Fasteners 106 are driven through each pair of concentrically aligned holes in the side flanges and the grid member top channel 51 positioned therebetween. The coupling clips 120 thus include two securement features to fixedly couple the clips to the terminal end portions of the grid members 72.

In one embodiment, top flange 121 has a free end portion 125 which is cantilevered and extends axially beyond the side flanges 122 by distance which is greater than the axial length of the side flanges (e.g. approximately equal or greater than the length in some embodiments). When mounted to the movable second and third cross grid members 72 in the position shown in FIGS. 3-10, the cantilevered free end portions of the top flanges 121 extend outwardly beyond the terminal ends of the grid members unencumbered by the side flanges. This allows the top flanges 121 to be compactly nested one on top of another without interference from stationary first cross grid member 72 and mounting bracket 102 when angularly adjusting the position of the movable second and third grid members 72. The elongated top flange 121 thus allows for a plurality of angle junctions, and several coupling clips 120 to be located at the same vertex or junction site and fastened together into an interlocking joint as further described herein.

Top flange 121 of coupling clips 120 include one but preferably two top facing symmetrical mounting holes 123 for forming a pivot connection between the cross grid members 72 as shown in FIGS. 3-10. Each of the two holes 123 is located proximately to the ends of the top flange 121(see, e.g. FIG. 11). One hole 123 is located on top flange 121 at the side flanges 122 and the other on the cantilevered free portion 125. The top facing holes 123 are easy to position from the coupling clip's centrally located vertical flange edge to an on module grid route. Once positioned, this establishes the vertex or junction location where the other grid members will terminate. Aligning the top facing holes 123 in the associated grid member allows for proper mitering and aligning of the remaining grid members to the desired layout angle. Installation of a pivot member 130 such as a mechanical threaded fastener in one embodiment in the concentrically aligned top facing holes 123 of all three grid members 72 secures the grid junction.

Referring back to FIGS. 3-10, an coupling clip 120 is shown fixedly attached to the terminal end of the stationary first grid member 72 via threaded fastener 106 extending through of each of the side flanges 122 of the coupling clip and bulbous top channel 51 of the first grid member. For the stationary grid member 72, the coupling clip 120 is positioned and orientated with the side flanges 122 positioned near the terminal end of the grid member 72 and the top flange 121 extending inwards along the grid member. The vertical edges of side flanges 122 extend beyond the vertical edge 129 of stationary grid member 72 by a distance so that top facing mounting hole 123 is preferably positioned beyond the edge of stationary grid member (see, e.g. FIG. 10). Positioning of hole 123 in this manner, which will form the pivot location, avoids interference between the vertically oriented pivot member 130 and top channel 51 of the stationary grid member 72 when the pivot member is inserted through the hole. The vertical edge 129 of the stationary grid member 72 is spaced horizontally apart from wall 10 by a distance or gap G selected to allow the movable second and third grid members 72 to be angularly adjusted without binding against the wall. The gap G may be adjusted using horizontal slot 109 in mounting bracket 102 and fastener 106 as previously described herein to properly position the stationary grid member.

The coupling clips 120 on the movable second and third grid members 72 are fixedly attached thereto in a reverse position or orientation to the foregoing coupling clip 120 on the stationary first grid member 72. For the movable grid members 72, the coupling clip 120 is positioned and orientated with the side flanges 122 positioned inwards from the terminal end of these grid members 72 and the cantilevered free portion 125 of the top flange 121 extends outward beyond the vertical edges 129 of these grid members. These vertical edges 129 may be cut diagonally in the field as shown (see, e.g. FIG. 10) to avoid interference with the stationary grid member 72. The coupling clip top flanges 121 of the movable second and third grid members 72 are overlapped on top of one another on the coupling clip 120 of the stationary grid member 72. The top facing holes 123 in each of the coupling clips 120 on the movable second and third grid members 72 are concentrically aligned with the top facing hole 123 of the coupling clip 120 on the stationary first grid member 72. Pivot member 130 is inserted vertically through the three concentrically aligned holes 123 to form a pivot connection. The second and third grid members 72 are thus pivotably coupled to the stationary grid member 72 and angularly movable relative to thereto and independently of each other. Because the stationary first grid member 72 occupies the 90 degree position relative to wall 10 and the perimeter trim bracket 104 occupies the 0 degree position, each of the movable second and third grid members 50 is adjustable between a plurality of possible angular positions between 0 and 90 degrees to wall 10 (including vertical reference plane Vp) and perimeter trim bracket 104.

In one embodiment, pivot member 130 may be threaded fastener as shown. In other possible embodiments, pivot member 130 may be a pin, threaded fastener (e.g. bolt) and nut assembly, rivet, or other. Pivot member 130 defines a vertical pivot axis P about which the second and third grid members 72 are pivotably and rotatably movable in substantially the same horizontal reference plane Hp in which the stationary first grid member 72 lies (accounting for slight elevational offsets due to the overlapping or stacked top flanges 121 of the coupling clips 120 on the moving grid members 72 comparable to the thickness of the top flanges). It bears noting that the foregoing orientation of coupling clip 120 on the stationary grid member 72 advantageously ensures a structurally robust pivot connection because the top hole 123 used to form the pivot location is disposed in the end portion of the coupling clip where the top flange 121 is reinforced and braced by the two side flanges 122. The stationary first cross grid member 72 and movable second and third cross grid members 72 may be mounted and function in the same manner previously described herein with respect to mounting bracket 102.

A method for forming a junction of ceiling grid members 72 will be briefly described with reference to FIGS. 3-10. In this embodiments, stationary first cross grid member 72 and movable second and third cross grid members 72 are provided. In one scenario, the coupling clips 120 may be preassembled and fixedly coupled to the first, second, and third grid members 72 in the manner previously described. The method further includes: fixedly attaching the grid junction mounting bracket 102 to a support structure which may be perimeter trim bracket 104 fixedly attached to structural wall 10; fixedly attaching stationary first grid member 72 to the mounting bracket 102; concentrically aligning a mounting hole 123 on the movable second grid member with a mounting hole on the stationary first grid member 72; concentrically aligning a mounting hole 123 on the movable third grid member with the mounting holes on the stationary first grid member 72 and movable second grid member 72; vertically inserting pivot member 130 through the concentrically aligned triad of holes; and pivotably moving and angularly adjusting the movable second and third grid members 72 in the horizontal reference plane Hp. Numerous variations of the foregoing method are possible and not limiting of the invention.

In one embodiment, the perimeter trim channel 104, grid junction mounting bracket 102, and coupling clips 120 may preferably be made of metal such as without limitation aluminum, steel, titanium, or other.

The remaining terminal ends of the cross grid members 72 opposite to the ends coupled to the grid junction mounting bracket 102 may be configured for mounting to adjacent main beam grid members 70 using any method known in the art, including for example without limitation interlocking tabs and slots, brackets, clips, fasteners, etc. and combinations thereof.

Figure 27:
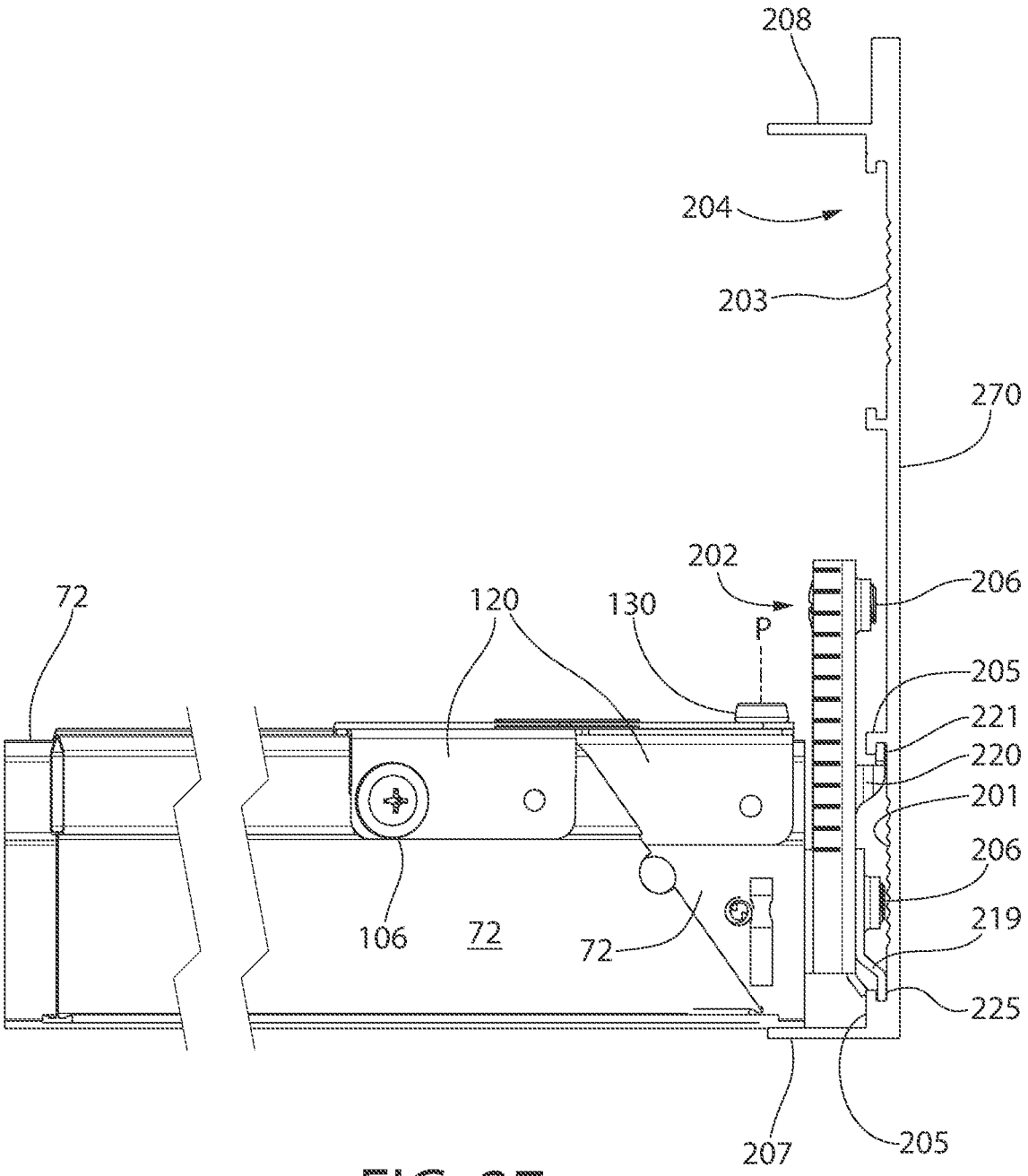
FIG. 27 is a side view of the grid mounting system.
Figure 28:
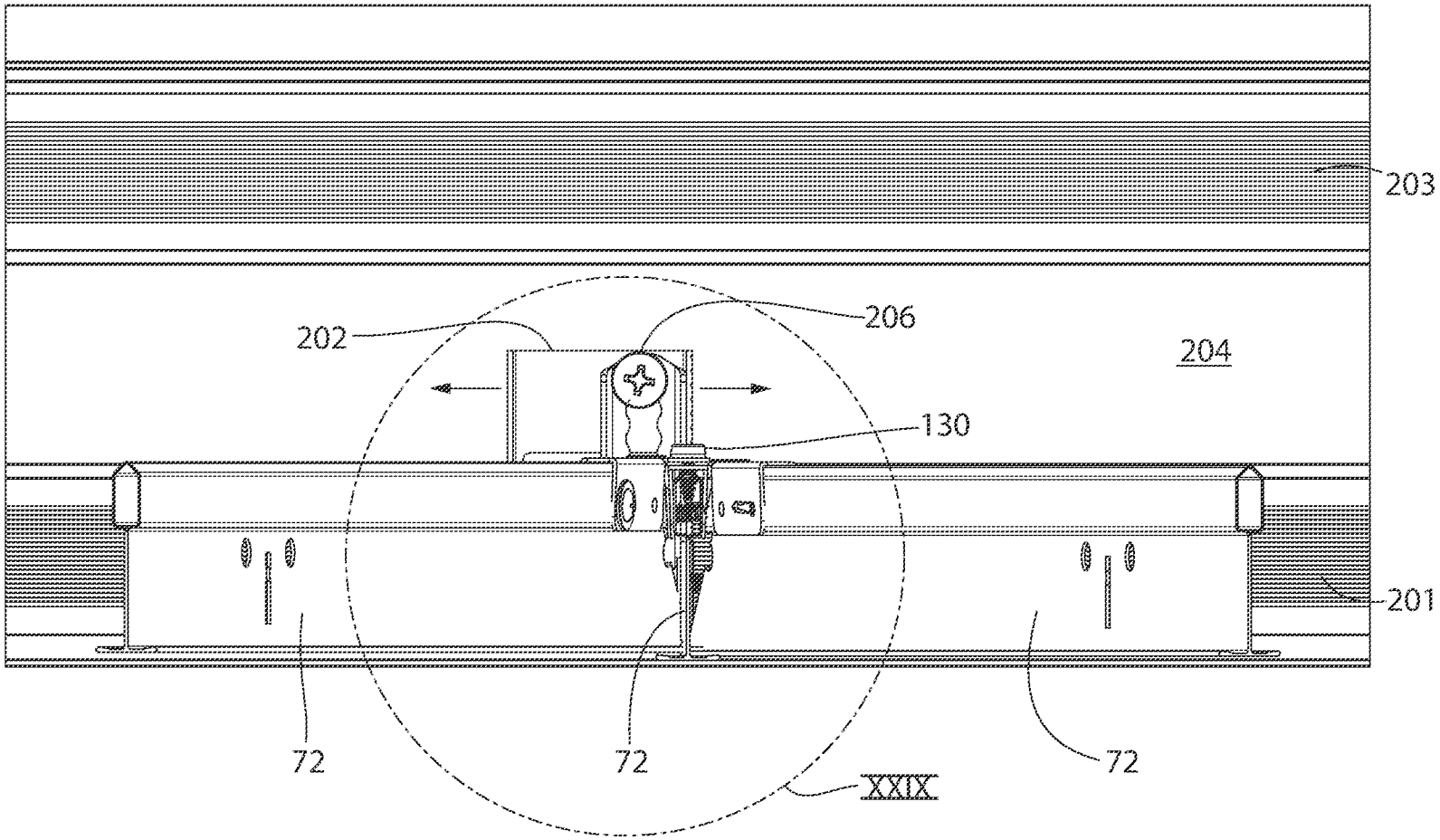
FIG. 28 is a front view thereof.
Figure 29:
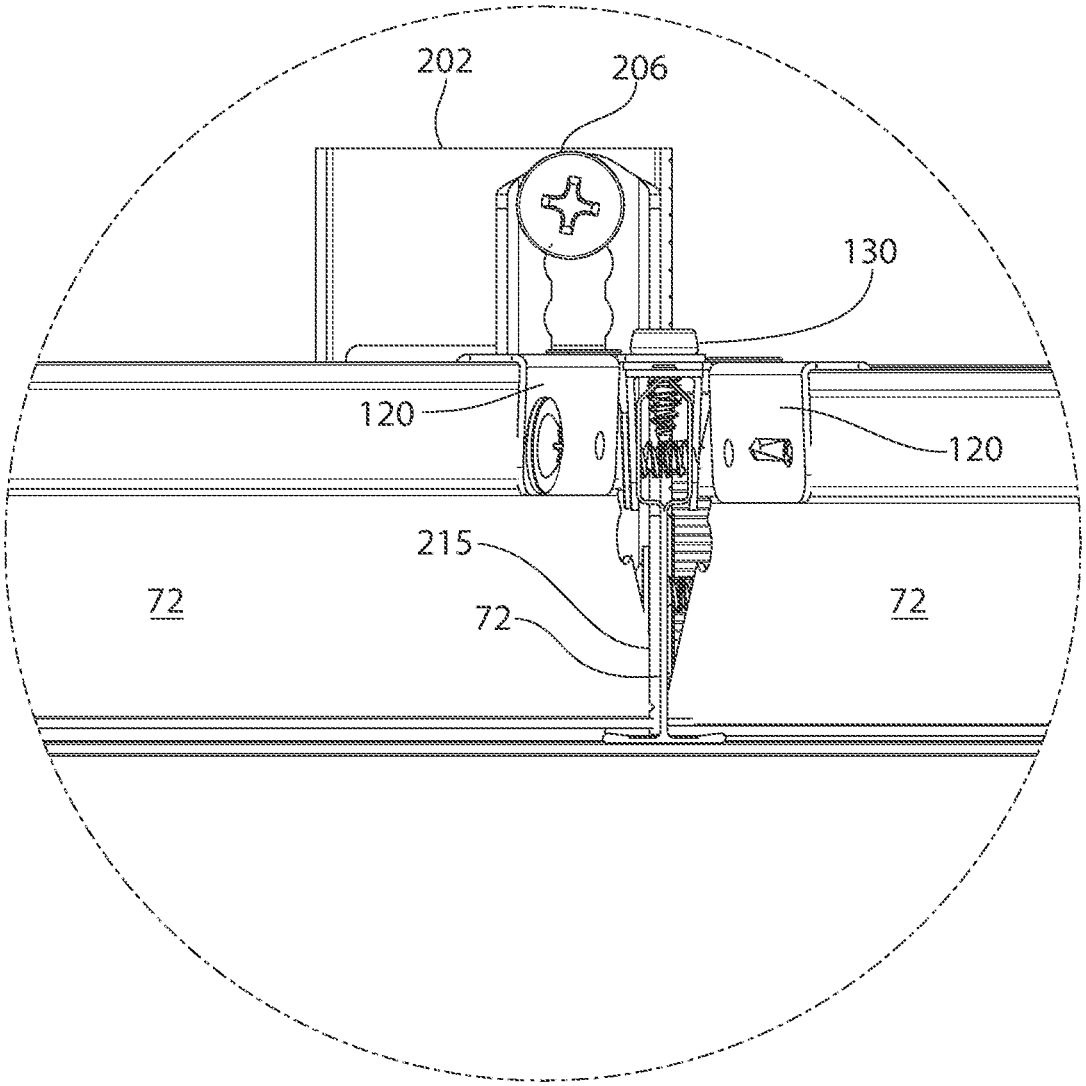
FIG. 29 is an enlarged detail taken from FIG. 28.

FIGS. 19-29 illustrate second embodiment of a grid mounting system 200 which includes a differently configured grid junction mounting bracket 202 and horizontal elongated perimeter trim bracket 204. In this embodiment, the mounting bracket 202 is slideably movable and adjustable in horizontal position along the trim bracket 204. The mounting bracket 202 and trim bracket 204 each comprise complementary configured mating retention features which maintains slideable and guided coupling of the mounting bracket to the trim bracket along a plurality of horizontal mounting positions. Trim bracket 204 includes at least one horizontally extending guide channel 201 extending for the entire length of the bracket in one embodiment. The channel 201 is bounded at top and bottom by a pair of vertically spaced apart upper and lower longitudinal retaining edges 205, which collectively define the retention feature of the perimeter trim bracket. Edges 205 are formed by raised L-shaped protrusions (in transverse cross section) having inwardly turned longitudinal ends facing towards the channel (i.e. one upward and one downwards as best shown in FIG. 27). In one embodiment, a second upper guide channel 203 spaced vertically apart from the lower guide channel 201 may be provided. The upper guide channel 203 similarly includes longitudinal edges 205 formed by L-shaped protrusions with inwardly turned longitudinal ends. The provision of two guide channels 201, 203 allows the perimeter trim bracket 204 to be vertically inverted and used in two different mounting positions.

Perimeter trim bracket 204 includes a vertical main flange 205 which can be attached to a structural wall 10, a horizontal lower flange 207 extending perpendicularly to flange 206, and a horizontal upper flange 208 similarly extending perpendicularly to flange 206. Lower flange 207 may be disposed at the bottom edge of main flange 206. Upper flange 207 may be disposed proximate to but spaced slightly downwards from the top edge of main flange 206. In contrast to perimeter trim bracket 104, trim bracket 204 has a body which is vertically elongated having a height at least twice that of the grid members 72 in one configuration. In other embodiments having a single guide channel 201, trim bracket 204 may have a smaller height than when two guide channels are provided as in the illustrated embodiment.

Figure 23:
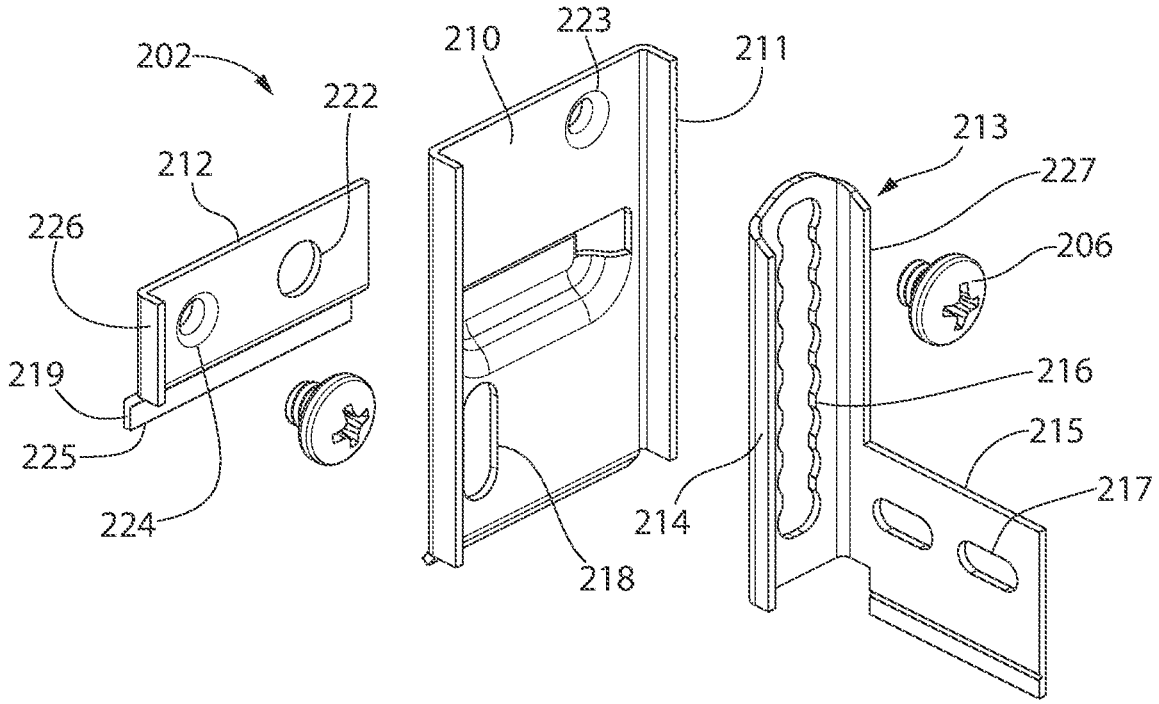
FIG. 23 is a front exploded perspective view of the grid junction mounting bracket of FIG. 19.
Figure 24:
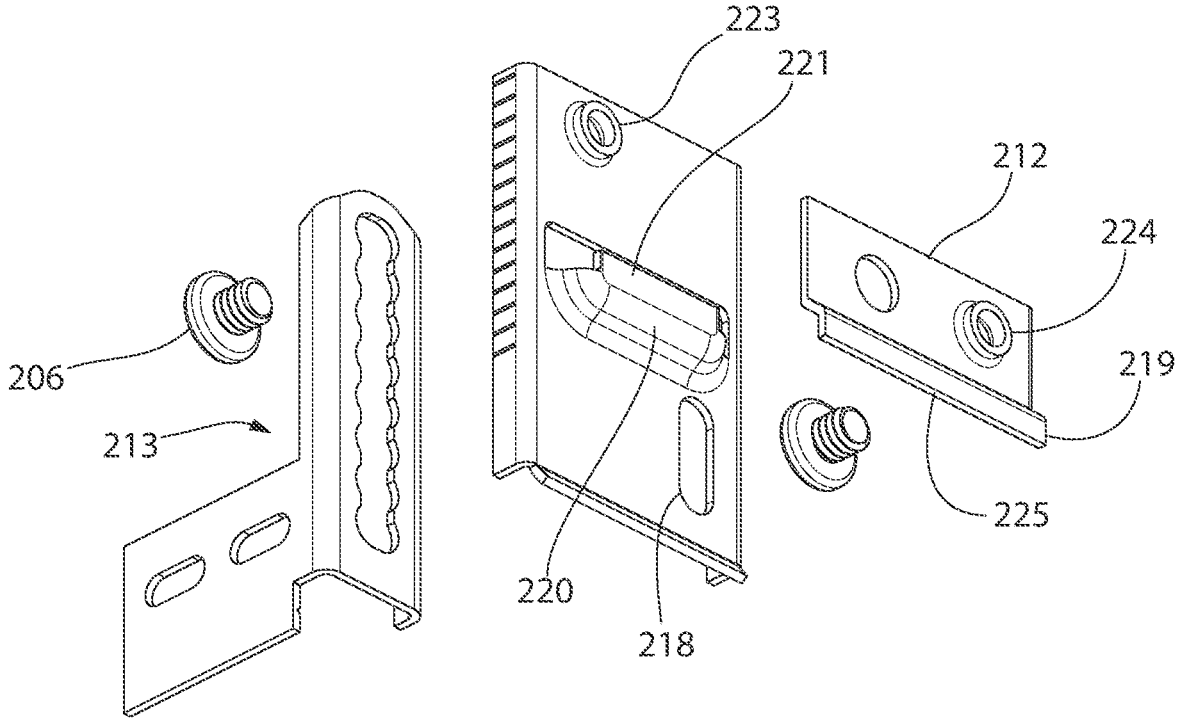
FIG. 24 is a rear exploded perspective view thereof.
Figure 25:
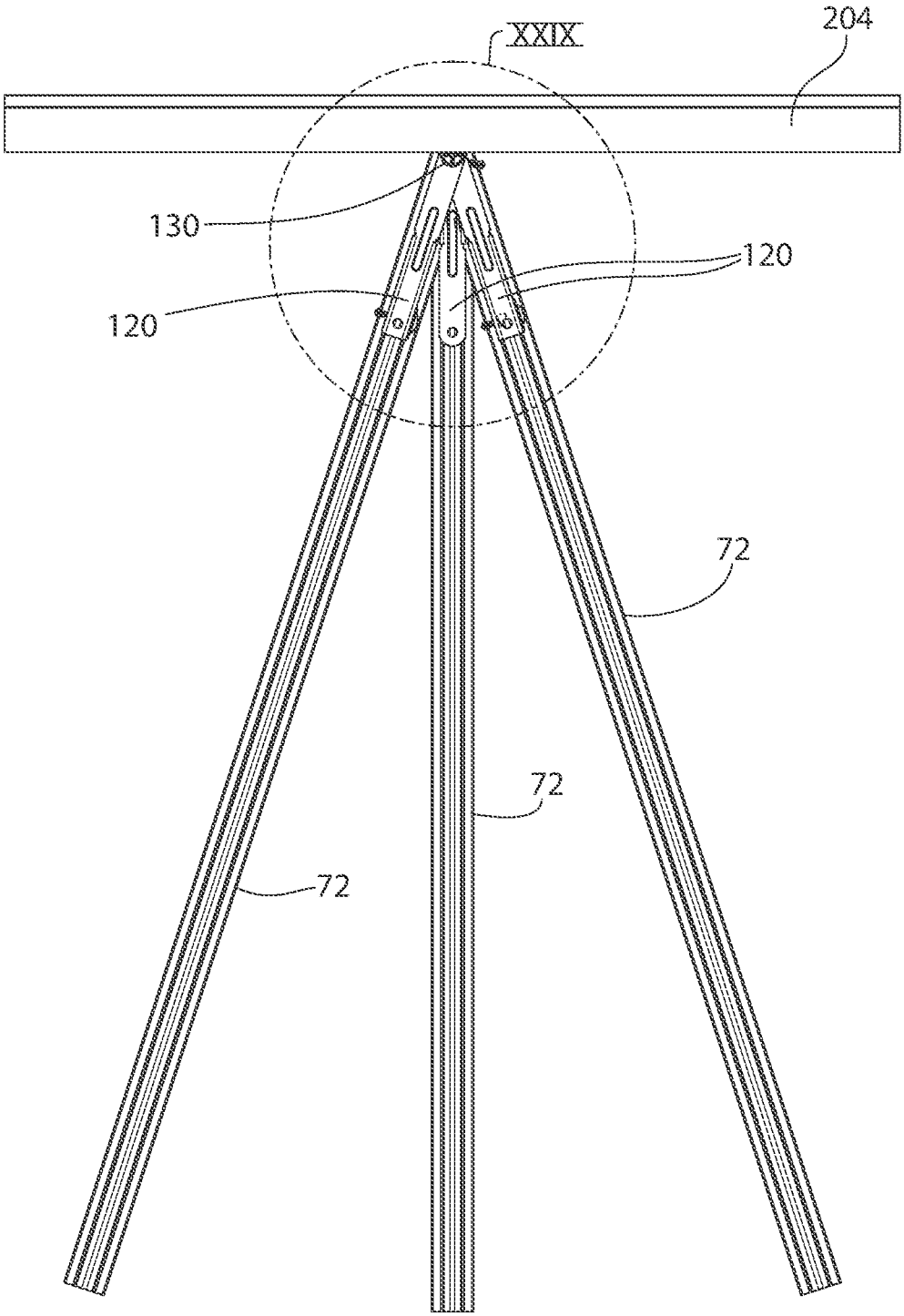
FIG. 25 is a top plan view of the grid mounting system.
Figure 26:
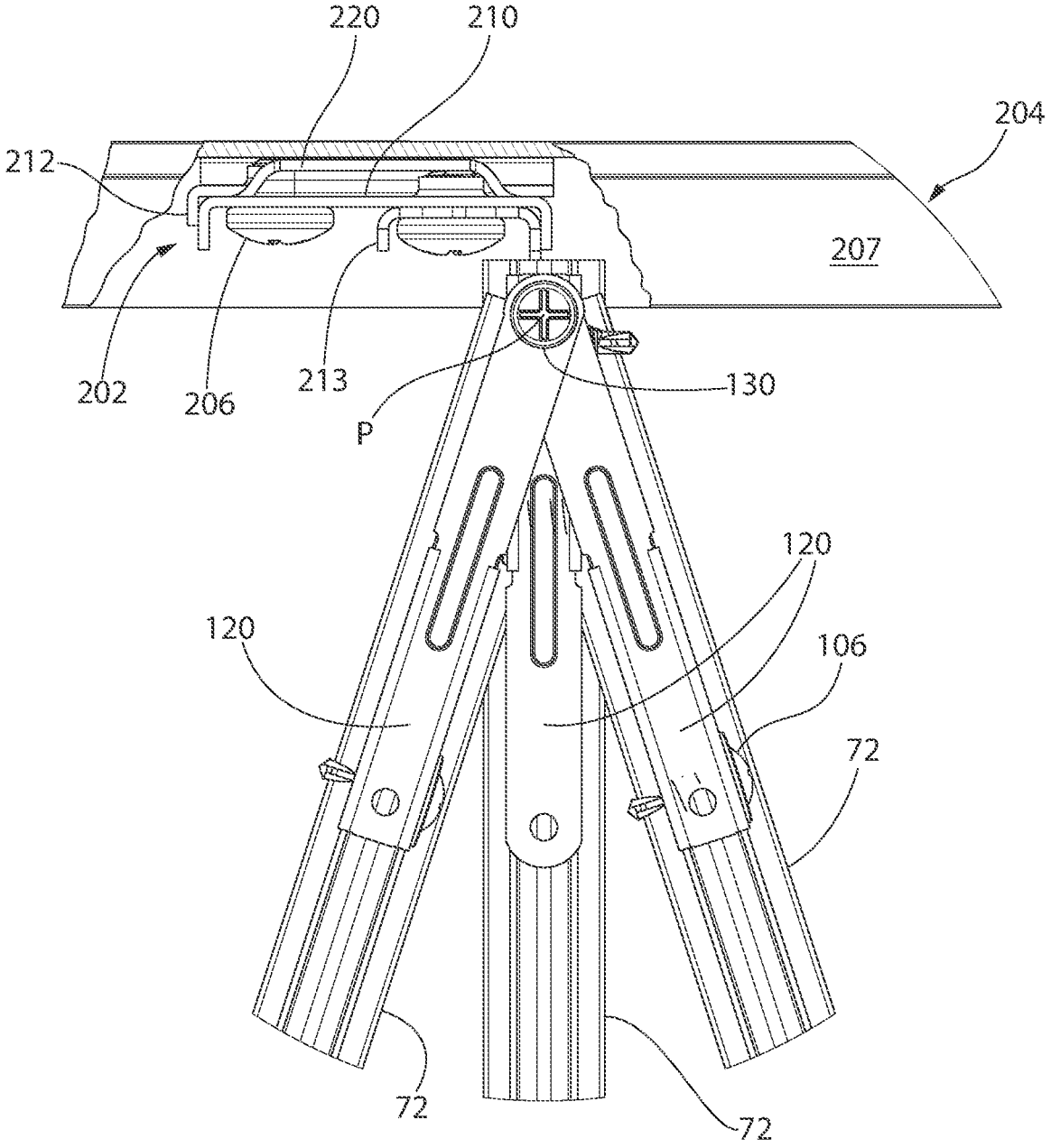
FIG. 26 is an enlarged detail taken from FIG. 25.

FIGS. 23 and 24 depict exploded views of grid junction mounting bracket 202. Referring particularly to these figures and additionally FIGS. 9-22 and 25-29, mounting bracket 202 is an assembly comprising includes a vertical main plate 210, a vertically adjustable retention plate 212 coupled thereto, and a vertically adjustable grid member support plate 213. Main plate 210 includes inward or forward turned guide lips 211 on each vertical side which extend inwards towards the room (i.e. away from perimeter trim bracket 204). Main plate 210 further includes a vertical slot 218, threaded hole or socket 223, and rearwardly extending L-shaped retention protrusion 220 which defines an upwardly turned retention edge 221. Mounting bracket 202 is horizontally movable along the channel 201 and trim bracket 204 in a plurality of possible mounting positions.

Retention plate 212 includes a through hole 222 and threaded hole or socket 224. An L-shaped retention protrusion 219 extends horizontally along the bottom of the retention plate and defines a downwardly turned retention edge 225. Retention protrusions 219 and 220 of mounting bracket 202 collectively define the retention feature of the mounting bracket which mutually engage the foregoing retention feature of the perimeter trim bracket 204 described above. An inward or forward turned guide lip 226 is formed on the vertical side of retention plate 212 nearest the threaded socket 224.

Grid member support plate 213 includes a vertically elongated mounting portion 214 which defines a vertical slot 216 and a forwardly extending cantilevered coupling portion 215 extending perpendicularly to the mounting portion for coupling and supporting a grid member 72 thereto. Mounting portion 214 is higher than coupling portion 214 in one embodiment. Coupling portion 215 includes a pair of horizontal slots 217. Support plate 213 includes inward or forward turned guide lips 211 on each vertical side which extend inwards towards the room (i.e. away from perimeter trim bracket 204). This forms a vertical channel just slightly wider than a threaded fastener 206 used to attach support plate 213 to main plate 210. Fastener 206 which may be screw as shown threadably engages socket 223 formed in the main plate. This allows the coupling portion 214 to be vertically adjusted in position for fixing the elevation of the stationary grid member 72 attached thereto via threaded fastener 106 in a similar manner to mounting bracket 102 described earlier. Slots 217 in coupling portion 215 of grid member support plate 213 allows horizontal adjustment of the stationary grid member 72 relative to the mounting bracket 202 in a similar manner to mounting bracket 102 also described earlier.

To mount the mounting bracket 202 to perimeter trim bracket 204, grid member support plate 213 may be loosely coupled to the front of main plate 210 via threaded fastener 206 inserted through slot 216. Slot 216 may include opposing rows of scalloped edges configured to define a plurality of vertically indexed mounting positions via engagement with the threaded shank of fastener 206. Retention plate 212 may be loosely attached to the rear of main plate 210 via threaded fastener 206, slot 218 in main plate 210, and threaded socket 224 in retention plate 212. The mounting bracket 202 is placed against perimeter trim bracket 204 and rear protrusion 220 is positioned in the lower channel 201 in this embodiment. While holding mounting bracket 202 against trim bracket 204, the mounting bracket is slid upward within channel 201 until the upwardly turned retention edge 221 on the rear of the mounting bracket main plate 210 engages the downwardly turned upper retaining edge at the top of channel 201. The guide lip 226 is formed on the vertical side of retention plate 212 slideably engages the guide lip 211 on the side of main plate 210 to guide movement of the retention plate. While holding the mounting bracket 202 in this position, the retention protrusion 219 on retention plate 212 positioned in channel 201 is vertically lowered relative to the main plate 210 until the downwardly turned retention edge 225 engages the lower longitudinal retaining edge 205 at the bottom of channel 201. Threaded fastener 206 which is loosely inserted through retention plate 212 is then fully tightened to lock the retention plate and mounting bracket 202 in position on perimeter trim bracket 204. Channel 201 may include horizontally extending and oriented serrations in one embodiment to help secure the retention plate 212 to the perimeter trim bracket 204. If the mounting bracket 202 requires repositioning on the trim bracket 204, the fastener 206 may simply be loosened allowing the mounting bracket to slide horizontally along the trim bracket to the desired positioned. Fastener 206 is then re-tightened at the new position.

Once the horizontal mounting position of mounting bracket 202 is established and the bracket is secured to the perimeter trim bracket 204, the method or process for mounting the stationary first member 72 and pivotally movable second and optionally third grid members 72 to grid junction mounting bracket 202 is the same as for mounting bracket 102 previously described herein. It will therefore not be repeated here for the sake of brevity. In this embodiment, however, the elevation or vertical position of the grid members relative to the perimeter trim bracket 204 may advantageously be adjusted in the field using threaded fastener 206 and slot 216 in mounting portion 214 of grid member support plate 213 (see, e.g. FIGS. 22 and 23) in the manner previously described herein.

Figure 30:
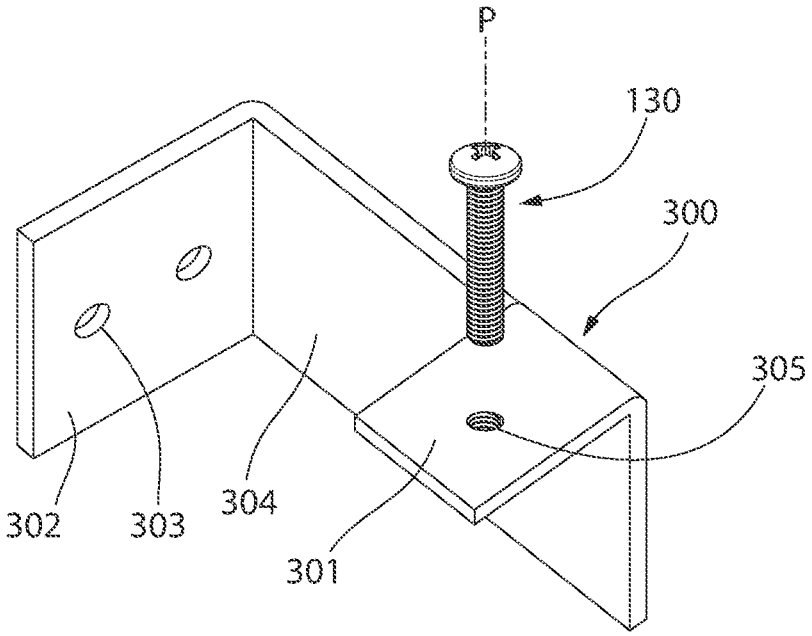
FIG. 30 is a perspective view of a third embodiment of a grid junction mounting bracket with a first embodiment of a pivot member.
Figure 31:
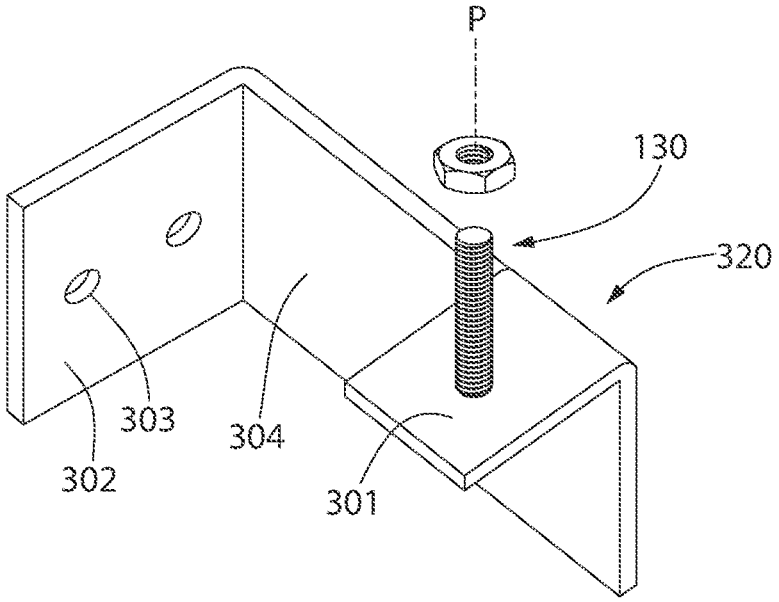
FIG. 31 is a perspective view thereof showing a second embodiment of the pivot member.

FIGS. 30 and 31 depict additional embodiments of grid junction mounting brackets which are configured to form a pivotable connection to grid members. Mounting bracket 300 in FIG. 30 includes a vertical first flange 302 configured for attachment to a support structure and a vertical cantilevered second flange 304 extending perpendicularly to flange 302. Flange 302 includes a pair of horizontal spaced mounting holes 303 which are configured to received threaded fasteners 106 for attaching bracket 300 to the support structure such as structural wall 10 or an intermediate perimeter trim bracket such as bracket 104 previously described herein (see, e.g. FIG. 6). A horizontal pivot flange 301 extends perpendicularly from second flange 304 towards flange 302. Flange 301 is oriented parallel to flange 302 and space horizontal apart therefrom as shown. In this embodiment, pivot flange 301 includes a top facing threaded hole or socket 305 which threaded engages a pivot member 130 which may be in the form a threaded fastener. Mounting bracket 300 provides pivotable mounting of one or more cross grid members 72 about pivot axis P which are angularly adjustable independently of each other between 0 and 180 degrees to first flange 302 and perimeter trim bracket 104. The grid members are pivotably coupled to pivot member 130 using the top hole 123 in the cantilevered portion 125 of coupling clips 120 (see, e.g. FIGS. 3 and 11).

Mounting bracket 320 is the same as mounting bracket 300 but instead has an alternative embodiment of a pivot member 130 in the form of a threaded stud fixedly attached pivot flange 301, as shown. The stud may be welded, soldered, or threadably engaged with pivot flange 301 via threaded hole or socket 305. Mounting brackets 300 and 320 may be made of any suitable metal or non-metallic material. In some non-limiting embodiments, brackets 300, 320 may be aluminum, steel, titanium, or other metals formed of plates bent to the shapes depicted.

In general, it will be appreciated that the sequential process or method steps for using or mounting the grid junction mounting brackets, grid members, coupling clips, or other components disclosed herein may of course be varied and performed in any order by the installer depending on the installation requirements and/or preferences of the installer. For example, using coupling clips 120 may be mounted on the grid members 72 before or after coupling the clips to the mounting brackets or pivot members 130. Accordingly, numerous variations of the installation methods described herein are possible and may be used in other embodiments. The invention is therefore not limited to the sequence of mounting steps enumerated herein.

The components of the ceiling and grid mounting systems disclosed herein may be constructed preferably of a suitable metal or non-metallic material if not otherwise specifically enumerated herein.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A grid mounting system comprising:

a support structure;

a mounting bracket fixedly coupled to the support structure;

an elongated first grid member pivotably coupled to the mounting bracket about a pivot axis, the elongated first grid member movable about the pivot axis in a plurality of angular mounting positions; and an elongated second grid member pivotably coupled to the mounting bracket about the pivot axis, the elongated second grid member movable about the pivot axis in a plurality of angular mounting positions relative to the elongated first grid member.

2. The grid mounting system according to claim 1, wherein the elongated first grid member is pivotably coupled to the mounting bracket by a vertically oriented pivot member which defines the pivot axis.

3. The grid mounting system according to claim 2, wherein the pivot member comprises a threaded fastener.

4. The grid mounting system according to claim 1, wherein the elongated first grid member and the elongated second grid member are pivotably movable in a horizontal plane of movement.

5. The grid mounting system according to claim 1, wherein the elongated first grid member and the elongated second grid member are movable independently of each other between 0 and 180 degrees relative to the support structure.

6. The grid mounting system according to claim 1, wherein the support structure comprises a trim bracket, the trim bracket comprising at least one horizontally extending guide channel.

7. The grid mounting system according to claim 6, wherein the mounting bracket is slideably movable and adjustable in a horizontal position along the trim bracket.

8. A grid mounting system comprising:

a support structure;

a mounting bracket slideably coupled to the support structure and movable in a plurality of horizontal mounting positions;

an elongated first grid member pivotably coupled to the mounting bracket and movable about a pivot axis in a plurality of angular mounting positions; and an elongated second grid member fixedly coupled to the mounting bracket in a stationary position and angularly disposed relative to the elongated first grid member;

wherein the pivot axis interests a longitudinal extension of a bulbous top channel of the elongated second grid member.

9. The grid mounting system according to claim 8, wherein the elongated first grid member is pivotably coupled to the mounting bracket by a vertically oriented pivot member which defines the pivot axis.

10. The grid mounting system according to claim 9, wherein the elongated first grid member is pivotably coupled to the elongated second grid member by the pivot member.

11. The grid mounting system according to claim 8, wherein the support structure comprises a perimeter trim bracket configured for attachment to a wall.

12. The grid mounting system according to claim 11, wherein the mounting bracket is slideably interlocked with the perimeter trim bracket by complementary configured retention features on the mounting bracket and perimeter trim bracket.

13. The grid mounting system according to claim 11, wherein the mounting bracket includes a vertical position adjustment feature configured to adjust an elevation of the elongated first grid member.

14. The grid mounting system according to claim 8, wherein the pivot axis lies in a vertical plane bisecting the elongated second grid member.

15. The grid mounting system according to claim 8, wherein the elongated first grid member is movable about the pivot axis in the plurality of angular mounting positions after being coupled to the mounting bracket.

16. A method of forming a junction of ceiling grid members within a grid mounting system comprising:

coupling clips to a stationary first grid member and second and third movable grid members;

fixedly attaching a mounting bracket to a support structure;

fixedly attaching the stationary first grid member to the mounting bracket;

concentrically aligning a mounting hole on the movable second grid member with a mounting hole on the stationary first grid member; concentrically aligning a mounting hole on the movable third grid member with the mounting holes on the stationary first grid member and movable second grid member; and vertically inserting a pivot member through the concentrically aligned triad of mounting holes.

17. The method according to claim 16, wherein the support structure comprises a perimeter trim bracket configured for attachment to a wall.

18. The method according to claim 17, wherein the mounting bracket is slideably interlocked with the perimeter trim bracket by complementary configured retention features on the mounting bracket and the perimeter trim bracket.

19. The method according to claim 16, wherein the mounting bracket comprises a vertical main plate, a vertically adjustable retention plate coupled to the vertical main plate, and a vertically adjustable grid member support plate.

20. The method according to claim 19, wherein the vertical main plate comprises inward turned guide lips and an extending L-shaped retention protrusion.

* * * * *